US010188958B2

(12) United States Patent
Liu et al.

(10) Patent No.: US 10,188,958 B2
(45) **Date of Patent: *Jan. 29, 2019**

(54) AUTOMATED DETECTION OF SURFACE LAYOUT

(71) Applicant: Anki, Inc., San Francisco, CA (US)

(72) Inventors: Tian Yu Tommy Liu, Berkeley, CA (US); Boris Sofman, San Francisco, CA (US); Hanns W. Tappeiner, San Francisco, CA (US); Mark Palatucci, San Francisco, CA (US)

(73) Assignee: Anki, Inc., San Francisco, CA (US)

( * ) Notice: Subject to any disclaimer, the term of this patent is extended or adjusted under 35 U.S.C. 154(b) by 231 days.

This patent is subject to a terminal disclaimer.

(21) Appl. No.: 15/009,697

(22) Filed: Jan. 28, 2016

(65) Prior Publication Data

US 2016/0144288 A1 May 26, 2016

Related U.S. Application Data

(63) Continuation-in-part of application No. 14/964,438, filed on Dec. 9, 2015, now Pat. No. 9,694,296, which (Continued)

(51) Int. Cl.

*A63H 17/26* (2006.01)
*A63H 18/16* (2006.01)

(Continued)

(52) U.S. Cl.

CPC ..... *A63H 17/26* (2013.01); *A63H 17/32* (2013.01); *A63H 17/395* (2013.01); *A63H 17/40* (2013.01);

(Continued)

(58) Field of Classification Search

None

See application file for complete search history.

(56) References Cited

U.S. PATENT DOCUMENTS 4,307,791 A 12/1981 De Bruine
4,658,928 A 4/1987 Seo (Continued)

FOREIGN PATENT DOCUMENTS

DE 19532540 3/1997
DE 202004018425 4/2006

(Continued)

OTHER PUBLICATIONS

Jadnckm, Jim's N Scale Train Layout, Mar. 29, 2009, https://www.youtube.com/watch?v=teDT55-O30g, p. 1.*

(Continued)

*Primary Examiner* — Tramar Harper

(74) *Attorney, Agent, or Firm* — Raubvogel Law Office

(57) ABSTRACT

A drivable surface includes a plurality of segments that can be arranged according to any desired configuration. One or more mobile agents are configured to automatically explore the drivable surface so as to ascertain the positions, orientations, and/or configurations of the various segments, as well as how they are connected to one another. The information collected during such exploration can be transmitted to a host device or other location, where a virtual representation of the drivable surface can be constructed based on the collected information.

45 Claims, 25 Drawing Sheets

Related U.S. Application Data is a continuation of application No. 14/574,135, filed on Dec. 17, 2014, now Pat. No. 9,238,177, which is a continuation of application No. 14/265,092, filed on Apr. 29, 2014, now Pat. No. 8,951,092, which is a continuation of application No. 13/707,512, filed on Dec. 6, 2012, now Pat. No. 8,747,182, said application No. 14/574,135 is a continuation of application No. 14/265,093, filed on Apr. 29, 2014, now Pat. No. 8,951,093, which is a continuation of application No. 13/707,512, filed on Dec. 6, 2012, now Pat. No. 8,747,182, which is a continuation of application No. 12/788,605, filed on May 27, 2010, now Pat. No. 8,353,737.

(60) Provisional application No. 61/181,719, filed on May 28, 2009, provisional application No. 61/261,023, filed on Nov. 13, 2009.

(51) Int. Cl.

| | |
|---|---|
| ***A63H 17/395*** | (2006.01) |
| ***A63H 30/04*** | (2006.01) |
| ***A63H 17/32*** | (2006.01) |
| ***A63H 17/40*** | (2006.01) |
| ***A63H 17/44*** | (2006.01) |
| ***A63H 18/02*** | (2006.01) |
| ***A63H 18/12*** | (2006.01) |

(52) U.S. Cl.

CPC ..... *A63H 17/44* (2013.01); *A63H 18/02* (2013.01); *A63H 18/12* (2013.01); *A63H 18/16* (2013.01); *A63H 30/04* (2013.01)

(56) References Cited

U.S. PATENT DOCUMENTS

| | | | | |
|---|---|---|---|---|
| 5,203,733 | A | 4/1993 | Patch et al. | |
| 5,452,901 | A | 9/1995 | Nakada et al. | |
| 5,697,829 | A | 12/1997 | Chainani et al. | |
| 6,012,957 | A | 1/2000 | Cyrus et al. | |
| 6,254,478 | B1 | 7/2001 | Namanny et al. | |
| 6,491,566 | B2 | 12/2002 | Peters et al. | |
| 6,780,078 | B2 * | 8/2004 | Hageman | A63H 19/14 446/175 |
| 6,783,425 | B2 | 8/2004 | McKeefery | |
| 7,097,532 | B1 | 8/2006 | Rolicki et al. | |
| 7,753,756 | B2 | 7/2010 | McDermott et al. | |
| 8,013,550 | B1 * | 9/2011 | Young | A63H 19/24 246/187 A |
| 8,160,994 | B2 | 4/2012 | Ong et al. | |
| 8,287,372 | B2 | 10/2012 | Hong et al. | |
| 2002/0102910 | A1 | 8/2002 | Donahue et al. | |
| 2002/0137427 | A1 | 9/2002 | Peters et al. | |
| 2003/0060287 | A1 | 3/2003 | Nishiyama | |
| 2003/0148698 | A1 * | 8/2003 | Koenig | A63H 18/16 446/15 |
| 2003/0232649 | A1 | 12/2003 | Gizis et al. | |
| 2004/0068415 | A1 | 4/2004 | Solomon | |
| 2004/0134336 | A1 | 7/2004 | Solomon | |
| 2004/0134337 | A1 | 7/2004 | Solomon | |
| 2004/0162638 | A1 | 8/2004 | Solomon | |
| 2004/0210347 | A1 | 10/2004 | Sawada et al. | |
| 2004/0266506 | A1 | 12/2004 | Herbrich et al. | |
| 2005/0186884 | A1 | 8/2005 | Evans | |
| 2006/0073760 | A1 | 4/2006 | Tremel et al. | |
| 2006/0073761 | A1 | 4/2006 | Weiss et al. | |
| 2006/0223637 | A1 | 10/2006 | Rosenberg et al. | |
| 2007/0017984 | A1 | 1/2007 | Mountz et al. | |
| 2007/0021863 | A1 | 1/2007 | Mountz et al. | |
| 2007/0021864 | A1 | 1/2007 | Mountz et al. | |
| 2007/0173171 | A1 | 7/2007 | Pal Benedek et al. | |
| 2007/0173177 | A1 | 7/2007 | Hirokawa et al. | |
| 2007/0293124 | A1 | 12/2007 | Smith et al. | |
| 2008/0026671 | A1 | 1/2008 | Smith et al. | |
| 2008/0108277 | A1 | 5/2008 | Nunez Serrano et al. | |
| 2009/0004948 | A1 | 1/2009 | Ando et al. | |
| 2009/0076784 | A1 | 3/2009 | Ong et al. | |
| 2009/0111356 | A1 | 4/2009 | Haass et al. | |
| 2009/0138497 | A1 * | 5/2009 | Zavoli | G09B 29/106 |
| 2009/0284553 | A1 | 11/2009 | Seydoux | |
| 2010/0093255 | A1 | 4/2010 | Yamamoto | |
| 2010/0099493 | A1 | 4/2010 | Horovitz | |
| 2010/0178966 | A1 | 7/2010 | Seydoux | |
| 2010/0203933 | A1 | 8/2010 | Eyzaguirre et al. | |
| 2010/0230198 | A1 | 9/2010 | Frank et al. | |
| 2010/0304640 | A1 | 12/2010 | Sofman et al. | |
| 2011/0047338 | A1 * | 2/2011 | Stahlin | G01C 21/28 711/154 |
| 2013/0018575 | A1 * | 1/2013 | Birken | G01B 11/2513 701/409 |
| 2016/0089612 | A1 | 3/2016 | Sofman et al. | |

FOREIGN PATENT DOCUMENTS

| | | |
|---|---|---|
| EP | 1103351 | 5/2001 |
| GB | 2385238 | 8/2003 |
| JP | 7016348 | 1/1995 |
| JP | 2001022264 | 1/2001 |
| JP | 2003346240 | 12/2002 |
| JP | 2005185655 | 7/2005 |
| KR | 100842566 | 7/2008 |
| WO | 2008039934 | 4/2008 |
| WO | 2009037677 | 3/2009 |

OTHER PUBLICATIONS

Zlot, Robert et al., "Multi-Robot Exploration Controlled by a Market Economy", 2009 IEEE, 9 pages.

* cited by examiner

AUTOMATED DETECTION OF SURFACE LAYOUT

CROSS-REFERENCE TO RELATED APPLICATION

The present application claims priority as a continuation-in-part of U.S. Utility application Ser. No. 14/964,438 for "Distributed System of Autonomously Controlled Mobile Agents", filed on Dec. 9, 2015.

U.S. Utility application Ser. No. 14/964,438 claimed priority as a continuation of U.S. Utility application Ser. No. 14/574,135 for "Distributed System of Autonomously Controlled Mobile Agents", filed on Dec. 17, 2014, which claimed priority as a continuation of the following applications:

- U.S. Utility application Ser. No. 14/265,092 for "Distributed System of Autonomously Controlled Toy Vehicles", filed on Apr. 29, 2014 and issued as U.S. Pat. No. 8,951,092 on Feb. 10, 2015, which claimed priority as a continuation of U.S. Utility application Ser. No. 13/707,512 for "Distributed System of Autonomously Controlled Toy Vehicles", filed on Dec. 6, 2012 and issued as U.S. Pat. No. 8,747,182 on Jun. 10, 2014; and
- U.S. Utility application Ser. No. 14/265,093 for "Distributed System of Autonomously Controlled Toy Vehicles", filed on Apr. 29, 2014 and issued as U.S. Pat. No. 8,951,093 on Feb. 10, 2015, which claimed priority as a continuation of U.S. Utility application Ser. No. 13/707,512 for "Distributed System of Autonomously Controlled Toy Vehicles", filed on Dec. 6, 2012 and issued as U.S. Pat. No. 8,747,182 on Jun. 10, 2014.

U.S. Utility application Ser. No. 13/707,512 claimed priority as a continuation of U.S. Utility application Ser. No. 12/788,605 for "Distributed System of Autonomously Controlled Toy Vehicles", filed on May 27, 2010 and issued as U.S. Pat. No. 8,353,737 on Jan. 15, 2013, which claimed priority from U.S. Provisional Patent Application Nos. 61/181,719, filed on May 28, 2009, and 61/261,023, filed on Nov. 13, 2009.

The present application is related to U.S. Utility application Ser. No. 13/963,638 for "Integration of a Robotic System with One or More Mobile Computing Devices", filed on Aug. 9, 2013 and issued as U.S. Pat. No. 8,882,560 on Nov. 11, 2014, which claimed priority from U.S. Provisional Patent Application No. 61/693,687, filed on Aug. 27, 2012.

All of the above-mentioned applications are incorporated herein by reference.

FIELD

The present disclosure relates to mobile agents operating in an environment including modular track segments.

SUMMARY

Many electronic toys are controlled by a human operator. Such examples include radio and remote controlled cars and model trains that are controlled through a handheld device.

These kinds of toys have little or no ability to sense and interact intelligently and flexibly with their environment. Also, they do not generally have the ability to adjust their behavior in response to the actions of other toys. Further, many toys are physically constrained to slot or track systems and are therefore restricted in their motion.

The above-described related U.S. Patent Applications describe, in part, systems and methods for providing a toy system that includes a drivable surface having a plurality of segments of various types. Each segment includes machine-readable codes that encode locations on the segment and that encode a location of the segment on the drivable surface. A mobile agent, such as a toy vehicle or other vehicle, includes at least one motor for imparting motive force to the mobile agent, an imaging system for taking images of the machine-readable codes, a mobile agent wireless transceiver, and a microcontroller. The microcontroller controls, via the motor of the mobile agent, detailed movement of the mobile agent on the drivable surface based on images taken of the machine-readable codes of the drivable surface by the imaging system. As described, the system also includes a host device, or basestation, able to determine (via wireless communication with each mobile agent's wireless transceiver) a current location of the mobile agent on the drivable surface. The controller can store a virtual representation of the drivable surface and can determine, based on said virtual representation and the current location of each mobile agent on the drivable surface, an action to be taken by the mobile agent. The controller sends signals to the mobile agents to cause them to take action, such as to move in a coordinated manner on the drivable surface, and the mobile agents act accordingly.

According to various embodiments, a drivable surface includes a plurality of segments that can be arranged according to any desired configuration. In order for a virtual representation of the drivable surface to be constructed and maintained, one or more mobile agents are configured to automatically explore the drivable surface so as to ascertain the positions, orientations, and/or configurations of the various segments, as well as how they are connected to one another. The information collected during such exploration can be transmitted to a host device, or basestation, or other location, where a virtual representation of the drivable surface can be constructed and/or updated based on the collected information.

In at least one embodiment, exploration is performed during normal operation of the system. Thus, while mobile agents are moving around the drivable surface in the course of normal operation (such as while users are playing with the system), they may also perform exploration functions. In at least one embodiment, this may involve exploring areas to which the mobile agent travels in normal operation; in another embodiment, the mobile agent(s) may be directed to make detours during normal operation, so as to explore previously unexplored areas.

In another embodiment, the exploration is performed as a preliminary step before normal operation of the system commences. Any suitable mechanism can be used for controlling the exploration of the drivable surface. In at least one embodiment, such exploration involves fully automated operation of the mobile agent(s); in another embodiment, a user can control the mobile agent(s) and thereby direct the progress and methodology of the exploration. In yet another embodiment, a combination of such approaches can be used, wherein a user has some control over where mobile agent(s) go, but the agent(s) also move in an automated manner, at least to some extent, so as to perform exploration functions in an efficient and effective manner.

In at least one embodiment, exploration involves detecting and reading machine-readable codes on segments of the drivable surface. Such machine-readable codes can specify shape, orientation, position, configuration, and/or any other aspects of the segments. As described in the above-referenced related applications, machine-readable codes can take any suitable form, such as for example, RFIDs, optical codes, magnetic codes, and/or the like; they may be visible or invisible to the human eye. In at least one embodiment, mobile agents read codes as they travel on the segments containing the codes; in another embodiment, mobile agents are capable of reading codes for nearby segments without necessarily driving on the segments containing the codes.

In at least one embodiment, mobile agents transmit information obtained from such machine-readable codes to a host device, thus enabling the host device to construct, update, or add to a virtual representation of the overall drivable surface. In at least one embodiment, such transmission takes place via any suitable wireless communication mechanism, such as via WiFi or Bluetooth.

The techniques described herein can be implemented using any form of drivable segments. Such drivable segments can be placed and oriented so that they form a track along which the mobile agents can drive. For example, the mobile agents may be toy vehicles, and the drivable segments can be configured to collectively form a race track along which the toy vehicles can race each other.

In at least one embodiment, the described system and method are capable of detecting changes to the configuration of the drivable surface that have taken place since the virtual environment was initially constructed. For example, a user may swap out one segment for another, either while the mobile agents are driving around, or during a break in play. The mobile agents can be configured to detect such a change by reading machine-readable codes on the newly placed segments, and send the updated information to the basestation, which adjusts the virtual environment accordingly. In this way, updates can take place seamlessly without interrupting the user experience.

In at least one embodiment, as described herein, the system is implemented as an application in entertainment, such as one in which toy race cars or other vehicles move around a track. However, one skilled in the art will recognize that other embodiments are possible, and that the techniques described herein are not limited to the particular embodiments involving toy vehicles and tracks.

In various embodiments, the mobile agents can operate autonomously, or under the direction or a user (or multiple users), or in response to commands from the host device (for example, in response to a determination by the host device that some portion of the drivable surface needs further exploration, or in some combination of autonomous and user-controlled operational modes.

BRIEF DESCRIPTION OF THE DRAWINGS

The accompanying drawings illustrate several embodiments and, together with the description, serve to explain various principles according to the embodiments. One skilled in the art will recognize that the particular embodiments illustrated in the drawings are merely exemplary, and are not intended to limit scope.

DETAILED DESCRIPTION

For illustrative purposes, the system will be described herein primarily in the context of a toy car racing game in which the mobile agents under user control are physical vehicles or accessories related to gameplay, competing on a physical track. Further details regarding the implementation of such a system, and its mechanisms for integrating virtual and physical environments, are set forth in related U.S. Utility application Ser. No. 13/707,512 for "Distributed System of Autonomously Controlled Mobile Agents", filed on Dec. 6, 2012 and issued as U.S. Pat. No. 8,747,182 on Jun. 10, 2014, and which is incorporated herein by reference. However, one skilled in the art will recognize that the techniques described herein can be implemented in other contexts and environments, and need not be limited to vehicles on a physical track. The term "vehicle" as used herein shall therefore be taken to extend to any mobile agent that is capable of being controlled and operated in the manner described herein, while also being represented in a virtual environment as described herein.

Although the system is described herein primarily in the context of an application in entertainment, one skilled in the art will recognize that the system can be implemented in many other contexts, including contexts that are not necessarily related to entertainment.

System Architecture

Figure 1:
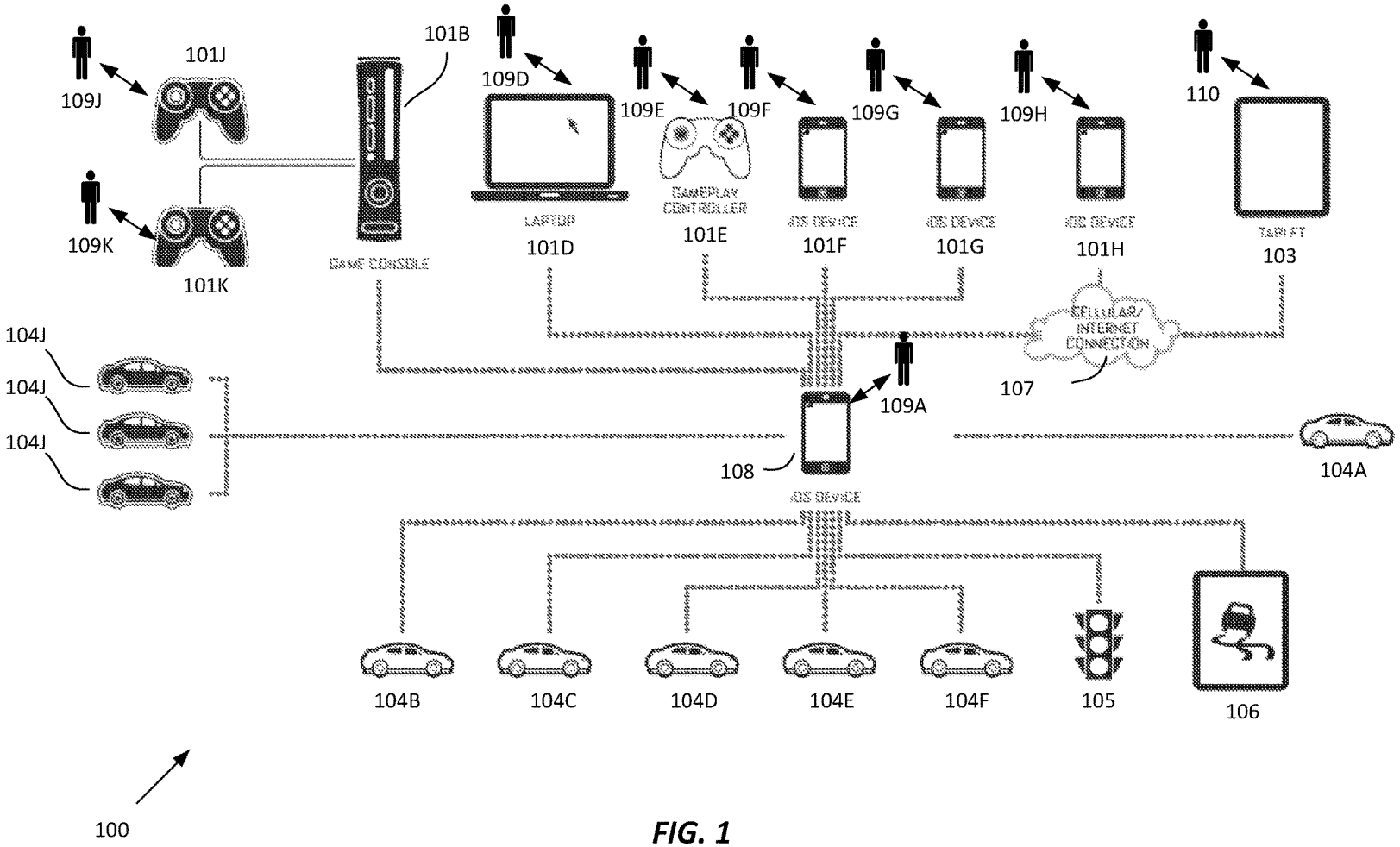
FIG. 1 is a block diagram depicting an architecture for implementing a system including mobile agents and a drivable surface, according to one embodiment.

Referring now to FIG. 1, there is shown an architecture for implementing the system according to one embodiment. In the system 100 depicted in FIG. 1, gameplay is hosted on a host device 108, which may be implemented on any suitable computing device, whether mobile or stationary, such as for example a smartphone, tablet, laptop computer, or the like, and/or any combination thereof. In at least one embodiment, host device 108 supports and runs various algorithms contained in software which implement game operations. Host device 108 and associated software are collectively referred to herein as a basestation or central control unit.

Any of a variety of different devices can serve as host device 108; examples include smartphones, tablet computers, laptop computers, desktop computers, video game consoles, and/or any other computing device capable of supporting the control software for the system. In at least one embodiment, such a device can use any suitable operating system, including for example and without limitation: iOS or MacOS, available from Apple Inc. of Cupertino, Calif.; Android, available from Google, Inc. of Mountain View, Calif.; or Windows, available from Microsoft Corporation of Redmond, Wash. In at least one embodiment, host device 108 is an iPhone or iPad, available from Apple Inc. of Cupertino, Calif., running a suitable software application ("app"). In at least one embodiment, software for controlling host device 108 may be provided via any suitable means, such as a down-loadable application ("app") that includes the appropriate functionality and gameplay structure to operate mobile agents 104A through 104F in physical space and to plan, coordinate and execute gameplay according to rules, user-controlled actions, and/or artificial intelligence. In at least one embodiment, host device 108 maintains the state of agents 104, and sends and receives commands to and from mobile agents 104. Host device 108 may also include a suitable user interface for facilitating user interaction with the system.

In at least one embodiment, mobile agents 104 are vehicles, and may occasionally be referred to herein as such, although they may be other objects or components.

In at least one embodiment, host device 108 is the central node for all activity and control commands sent to agents 104 and/or other components such as accessories 105, 106, whether the commands originate from algorithms running on host device 108 or are routed through host device 108 but originate from control devices 101D through 101K controlled by users 109D through 109K who are physically present or remotely located. In other embodiments, a more distributed architecture may be implemented wherein host device 108 need not be the central node for all activity and control commands.

The example shown in FIG. 1 includes a specific number of controllers 101D through 101K, agents 104B through 104H, accessories 105, 106 (which may also be considered a type of agent), AI-controlled mobile agents 104J (which may also be considered a type of agent), and other components. One skilled in the art will recognize that the particular quantities of these components depicted in FIG. 1 and described herein are merely exemplary, and that the system can be implemented using any other quantities, and/or with some of the components being omitted if appropriate.

In the architecture of FIG. 1, system 100 is implemented in a centralized manner, wherein controllers 101D through 101K and mobile agents 104, along with other components, communicate with host device 108. As depicted, in at least one embodiment, multiple users 109 (or players) can control multiple agents in the form of mobile agents 104A through 104F, while other agents 104J may be controlled by means of artificial intelligence.

As shown in FIG. 1, any number of external devices may be connected to host device 108 via any suitable communications protocol, such as for example a cellular/Internet connection 107. The various external devices may or may not be identical to host device 108. Some or all of the external devices serve as player controllers. FIG. 1 depicts various examples of devices that can be used as player controllers, including: game console 101B with any number of controllers 101J, 101K (controlled by users 109J, 109K, respectively): laptop computer 101D (controlled by user 109D); stand-alone controller 101E (controlled by user 109E); and smartphones 101F, 101G, and 101H (controlled by users 109F, 109G, and 109H, respectively). In at least one embodiment, any or all of controllers 101 can be an iPhone or iPad, available from Apple Inc. of Cupertino, Calif., running a suitable software application ("app"). Controllers 101J, 101K, 101E can be of any suitable type, including for example controllers that are commonly used with console game devices.

In the embodiment depicted in FIG. 1, a game is hosted on host device 108. Host device 108 supports gameplay in physical space in a physical environment (such as a race track) as well as in a virtual environment under the direction of software; the state of the virtual environment is maintained in memory on host device 108 and/or elsewhere.

In at least one embodiment, artificial intelligence software runs on host device 108 and issues commands (via wireless communication mechanisms or other mechanisms) to control one or more mobile agents 104J operating on track 601. In other embodiments, software for controlling mobile agents 104J may be located elsewhere, and/or may run on mobile agents 104J themselves.

In at least one embodiment, host device 108 can simultaneously serve as a control unit for a human user 109A controlling a mobile agent 104 (in the depicted example, human user 109A uses host device 108 to control mobile agent 104A). Such functionality can be provided on host device 108 while host device 108 also serves as a conduit and interpreter for control commands incoming from other devices 101D through 101K controlling other mobile agents 104B through 104F. In another embodiment, host device 108 does not serve as a control unit for a human user 109, but rather operates as a dedicated central control unit.

In at least one embodiment, mobile agents (such as mobile agents 104B through 104F) under user control do not need to be consistent in form or function. For example, users 109 may be given the opportunity to control objects or elements other than mobile agents (such as traffic lights, railway crossings, gun turrets, drawbridges, pedestrians, and/or the like).

Player controllers 101D through 101K may communicate directly with host device 108 or they may communicate via intermediary devices. For example, in FIG. 1, controllers 101J and 101K communicate with host device 108 via game console 101B. Similarly, any number of tiers of connections can be configured between player controllers and the host device, such as one or more smartphones connecting to the host device through a succession of devices networked back to the host device.

FIG. 1 depicts an example in which mobile agents 104B through 104F are controlled by human users 109B through 109F, respectively. Additional agents, referred to as accessories 105, 106, may also be controlled by human users 109, or they may operate automatically (for example, under the direction of artificial intelligence software running at host device 108 or elsewhere). Each accessory 105, 106 may be a physical or virtual item that can be powered or passive, and that can be used to affect aspects of the gameplay environment and/or other agents 104 directly. In this example, accessory 105 is a physical traffic light. Other examples of physical accessories can be barriers, crossing gates, drawbridges, and/or the like; such devices can be communicatively coupled to host device 108 so as to control their operation in connection with gameplay. In at least one embodiment, a user 109 can change the physical state of accessory 105 and thereby influence gameplay.

Accessory 106 is an example of a virtual accessory, which has no physical component other than a computing device (such as a smartphone or tablet computer or the like) with an appropriate output device (such as a display screen). Virtual accessory 106 can be physically placed at a particular location in the physical game environment to render the accessory appropriately in both appearance and state. Further descriptions of such virtual accessories can be found in the above-referenced related applications. In various embodiments, accessories 105, 106 need not rely on a human user for operation but can operate under the control of artificial intelligence software running on host device 108 and/or elsewhere.

It can be appreciated by one skilled in the art that as the number of users 109 and the number of AI-controlled opponents increases, the performance demands on host device 108 likewise increases. Depending on the number of agents 104 and the capacity of host device 108, the increases in computational requirements, for example, can impact game performance. In at least one embodiment, the system is implemented in a distributed environment, wherein, for example, host device 108 has the capacity to distribute portions of its logic to any number of devices to which it is connected and which are capable of supporting execution of said logic. Examples of these include smartphones, tablet computers, laptops, game consoles, and/or the like, but can also be any suitable devices capable of providing the necessary support to run the logic assigned to it. In at least one embodiment, for example, some of the processing tasks associated with operating system 100 can be distributed to one or more controllers 101D through 101H.

It is not necessary that the distribution remain local; in at least one embodiment; logic can be distributed to, for instance, one or more remotely located servers. A modular design to the structure of host device 108 can lend itself to convenient distribution of logic, and the type of logic processes offloaded from host device 108 need not be of one particular type of function or process. In at least one embodiment, for example, the distribution of logic can be prioritized according to computational and memory demand, such that those most taxing of host device's 108 resources are the first to be allocated elsewhere.

It is not necessary that the wireless interface employed to communicate with and/or among controllers 101D through 101H be identical to that used to connect to agents 104A through 104F under the users' 109 control. For example, it is possible that host device 108 communicates with controllers 101D through 101H via Wi-Fi, while host device 108 communicates with agents 104A through 104F via Bluetooth. In such a case, host device 108 can serve as a bridge between a high-power protocol (such as Wi-Fi) and a low-power protocol (such as Bluetooth). The advantage of such an approach can be appreciated in instances in which mobile agents 104 controlled by users 109 via host device 108 or controlled directly by host device 108 (in the case of mobile agents 104J under AI control) have limited power budgets.

Another benefit afforded by the use of Bluetooth, in particular Bluetooth Low Energy (BTLE or BLE) or similarly capable wireless protocol, is that agents 104 can use the wireless protocol to communicate with similarly enabled BTLE/wireless devices. In one embodiment, for example, a user 109 wishing to assume control of a particular mobile agent 104 or active smart accessory 105 can bring the intended controller 101 (e.g., a BTLE-equipped smartphone) in proximity to the desired mobile agent 104. Leveraging BTLE's capability of determining relative distance or proximity to another BTLE-enabled device, a user 109 can bring two BTLE-equipped devices within a threshold range of distance. In at least one embodiment, this can prompt a data exchange between the smartphone (e.g., 101F) and mobile agent 104, presenting the user 109 with the option of selecting mobile agent 104 for play. The selection is subsequently relayed to host device 108 indicating the pairing between mobile agent 104 and the user's 109 smartphone 101, now designated as mobile agent's 104 control device.

In various embodiments, BTLE data exchanges among mobile agents 104 and/or similarly wirelessly-enabled agents can be used in other ways. For example, users or observers can receive information about the status of an agent 104 with respect to gameplay, overall lifetime usage, and/or historic achievements, and/or they can perform diagnostics or customize the unit.

As described above, controllers 101D through 101H can be implemented using any suitable devices. Again, less sophisticated controllers 101J, 101K can be used, such as wireless gamepads or joysticks. In instances in which a gamepad or joystick 101J, 101K is used which is not equipped with a wireless communication module supporting direct communication with host device 108, the connection to host device 108 can be achieved through a game console 101B or other intermediary, or through the use of a dongle (not shown) that plugs into an appropriate port on host device 108. Such a dongle links wirelessly to controller 101 and passes communications through the port into which it is plugged. Alternative embodiments of the dongle can include units that implement a bridge between a wireless protocol compatible with controller 101 and a wireless protocol compatible with host device 108.

Figure 2:
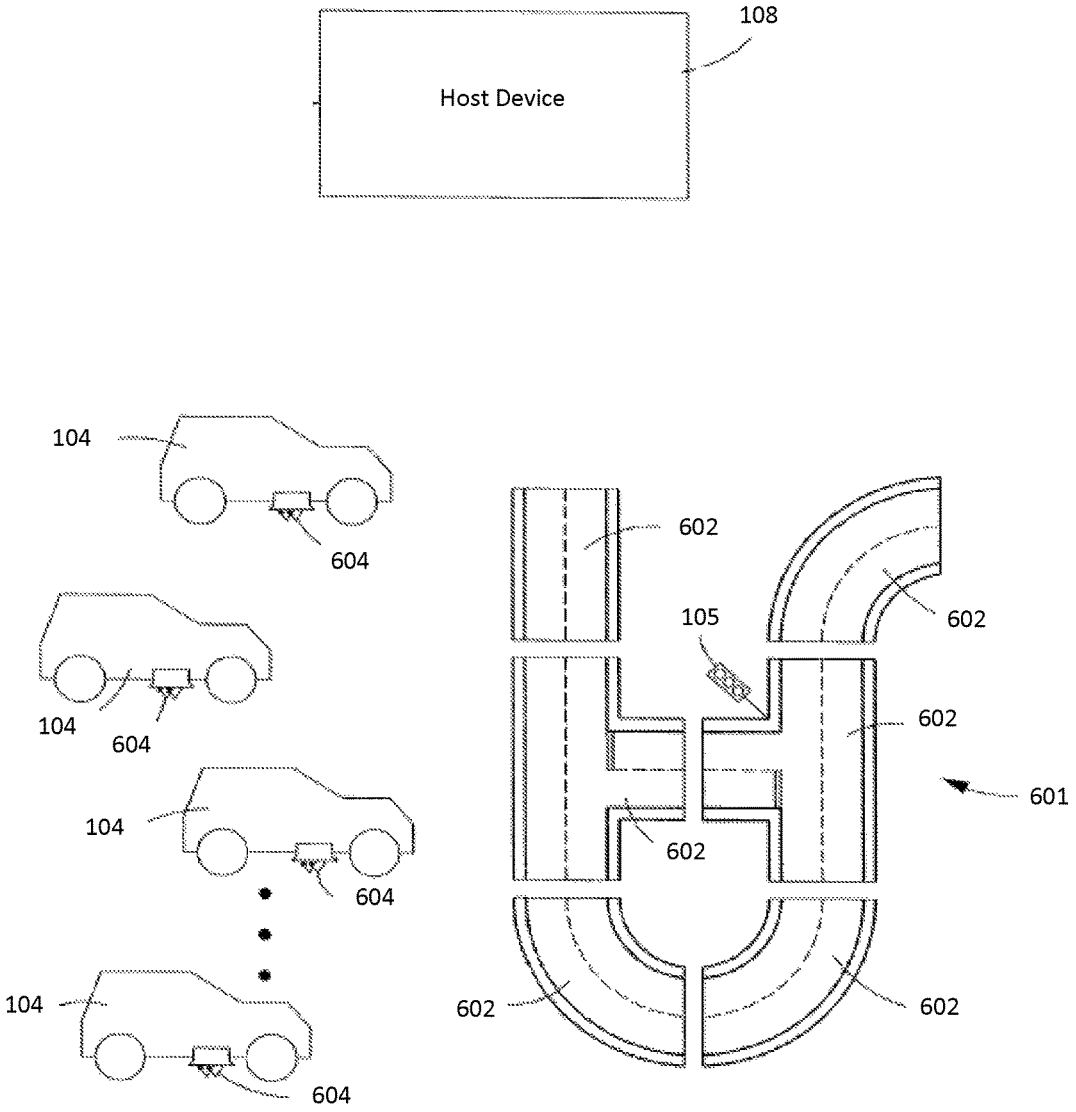
FIG. 2 is an overview of system components according to one embodiment, namely, a drivable surface, one or more mobile agents, a host device, and a user interface.

Referring now also to FIG. 2, there is shown an example of an embodiment for implementing a gameplay environment wherein mobile agents 104 (such as race cars) race on a drivable surface 601 (such as a race track), according to one embodiment. One skilled in the art will recognize, however, that such an embodiment is merely one example of an implementation; for example, the system can be implemented in an entirely different physical environment, with agents other than vehicles, and/or with different types of tracks or no track at all.

As described in the above-referenced related U.S. Utility Applications, drivable surface 601 is, in at least one embodiment, a physical model of one or more roads, and can include objects such as stop signs, traffic lights 105, railroad crossings, and/or the like. Mobile agents 104 may be vehicles, such as toy vehicles, capable of independent motion. Mobile agents 104 can be physically modeled after cars, trucks, ambulances, animals, or any other desired form. In at least one embodiment, each mobile agent includes one or more sensors 604 that can read information from drivable surface 601 and a communication module (not shown) that can send and receive commands and/or other information to/from host device 108, for example via wireless means.

Mobile Agents 104

Figure 10:
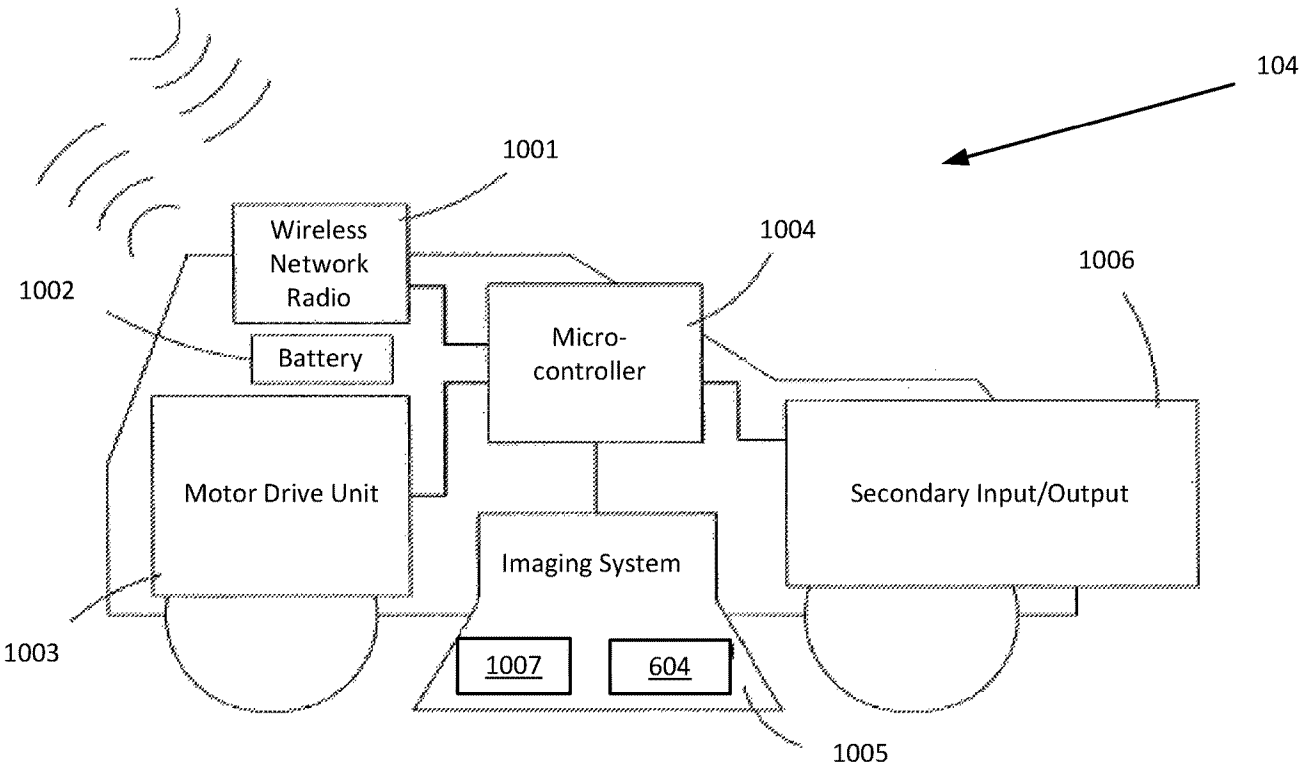
FIG. 10 is a block diagram depicting a functional architecture for a mobile agent according to one embodiment.

Referring now to FIG. 10, there is shown a block diagram depicting a functional architecture for a mobile agent 104 according to one embodiment. As mentioned above, in one embodiment, each mobile agent 104 is a vehicle, such as a toy vehicle, capable of moving along drivable surface 601. Any number of such mobile agents 104 can be provided. In at least one embodiment, movement of mobile agent 104 is not constrained by a physical barrier like a slot or track. Rather, mobile agent 104 can freely move anywhere along drivable surface 601. In at least one embodiment, mobile agent 104 is in periodic or continuous wireless contact with host device 108, both to receive instructions from host device 108 and to transmit information to host device 108 about the configuration and layout of drivable surface 601.

In various embodiments, each mobile agent 104 can be fully controlled by host device 108, or through hybrid control between a user via a controller 101 and host device 108. If a user controls a mobile agent 104, he or she can choose to have the mobile agent 104 and/or host device 108 handle low level controls such as steering, staying within lanes, and/or the like, allowing the user to interact with the system at a higher level through commands such as changing speed, turning directions, honking, and/or the like.

One skilled in the art will recognize that the architecture of mobile agent 104 as described and depicted herein is merely exemplary. In at least one embodiment, mobile agent 104 includes several components, such as the following:

Microcontroller 1004: This component performs control functions to allow mobile agent 104 to drive, sense, and communicate with host device 108 host device 108 and monitor its current state (such as position on drivable surface 601, speed, battery voltage, and/or the like). In at least one embodiment, microcontroller 1004 is low-cost and consumes little power, but is powerful enough to: a) intelligently deal with large amounts of sensor data and communications requirements, and b) perform high-speed steering and speed control. In at least one embodiment, microcontroller 1004 includes a variety of peripheral devices such as timers, PWM (pulse width modulated) outputs, A/D converters, UARTS, general purpose I/O pins, etc. One example of a suitable microcontroller 1004 is the LPC210× with ARM7 core from NXP.

Wireless network radio (i.e., wireless radio transceiver) 1001: This component operates under the control of microcontroller 1004 to facilitate communication between microcontroller 1004 and host device 108. Potentially, many mobile agents 104 may be driving on drivable surface 601 simultaneously, and host device 108 can communicate with all of them, regardless of whether they are controlled by users, by host device 108, or both. In at least one embodiment, mobile agents 104, host device 108, controllers 101, and/or other components can be part of a wireless network which can handle multiple (potentially hundreds of) nodes. In at least one embodiment, the network topology can be set up as a star network, where each mobile agent 104, controller 101, and other component communicates with host device 108, which then relays information to other components as appropriate. In another embodiment, a mesh network topology can be used, wherein nodes can communicate directly with other nodes. Examples of suitable wireless network technologies include ZigBee (IEEE/802.15.4), WiFi, Bluetooth, and/or the like. Specifically, ZigBee (IEEE/802.15.4) or related derivatives like SimpliciTI from Texas Instruments offer the desired functionality like data rate, low power consumption, small footprint and low component cost.

Imaging system 1005: This component allows mobile agent 104 to determine its location on drivable surface 601, by reading codes 301 on drivable surface segments 602. In at least one embodiment, imaging system 1005 can include a 1D/2D CMOS optical imaging sensor 604 configured to face drivable surface 601 as mobile agent 104 moves along it. Sensor 604 can take images of drivable surface 601 at high frequencies (at times up to 500 Hz or more). As described herein, drivable surface segments 602 can include machine-readable codes 301 that may be invisible to the human eye. In at least one embodiment, imaging system 1005 can include a light source 1007 that emits light at a specific (for example NIR) frequency so as to enable sensor 604 to read codes 301.

In at least one embodiment, a 1D linear pixel array TSL3301 from TAOS INC or a MLX90255BC from Melexis can be used as sensor 604. The image of a surface segment 602 can be focused, for example, with a SELFOC lens array and illuminated by an NIR LED light source 1007 emitting light, for example, at 790 nm. In at least one embodiment, microcontroller 1004 reads codes 301 at a sufficiently high frequency from imaging system 1005 and uses classification algorithms to interpret the codes 301 from each reading, so as to generate meaningful results even as mobile agent 104 moves along surface 601 at its top speed. Microcontroller 1004 transmits parsed codes 301 to host device 108 via wireless network radio 1001 for interpretation by host device 108.

Secondary input/output system 1006: This can include components which are not critical for the core operation of mobile agent 104, but which add functionality to allow for more realistic performance; examples include lights, speaker, battery voltage sensing, back EMF sensing, and the like.

Battery 1002: This component powers mobile agent 104. In at least one embodiment, a lithium polymer battery 1002 can be used; however, any suitable battery (or other power source, such as a photovoltaic cell) can be used. In at least one embodiment, mobile agent 104 uses an A/D converter (not shown) in series with a voltage divider (not shown) to enable microcontroller 1004 to measure the voltage of battery 1002. This information can be forwarded to host device 108, which then plans accordingly. For example, when battery 1002 is at very low voltage, host device 108 can react immediately and stop the operation of mobile agent 104 if necessary. In at least one embodiment, battery 1002 is connected to the bottom of mobile agent 104 to supply outside-accessible charging connectors (not shown). As described in the above-referenced related applications, such connectors can be specially designed to not only allow easy recharge of mobile agent's 104 battery 1002, but also for mobile agent 104 to drive itself onto a charging station (not shown) without the help of a user.

Segments 602 of Drivable Surface 601

As shown in FIG. 2, drivable surface 601 can include any number of segments 602. Such segments 602 may connect at specified connection points and can be reconfigured, either by the user or automatically, or by some other entity, to construct any desired structure. This structure is referred to as drivable surface 601.

In at least one embodiment, individual segments 602 of drivable surface 601 can contain machine-readable codes to allow mobile agents 104 to ascertain their position as well as to determine the placement, orientation, and configuration of segments 602. Mobile agents 104 identify their respective positions on drivable surface 601 by using sensors 604 to read such codes on segments 602 as mobile agents 104 drive over them.

Figure 3:
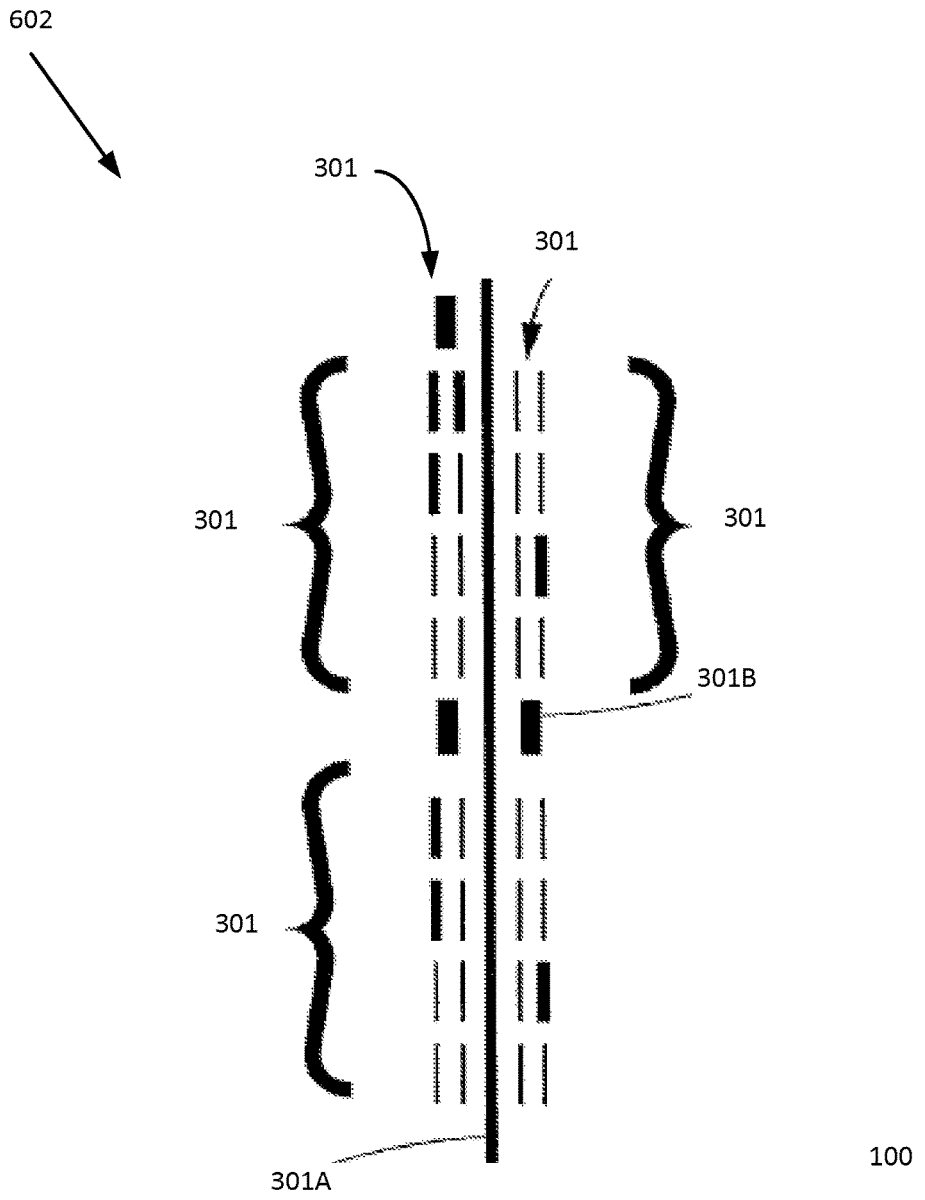
FIG. 3 depicts exemplary machine-readable codes that may be included on a segment of the drivable surface shown in FIG. 2, wherein the codes encode information regarding the identity, position, and/or configuration of the segment, according to one embodiment.

Any suitable codes can be used, whether visible or invisible to the human eye. Referring now to FIG. 3, there are shown exemplary machine-readable codes 301 that may be included on a segment 602, wherein codes 301 encode information regarding the identity, position, and/or configuration of segment 602, and also provide information to allow mobile agents 104 to ascertain their positions on segment 602, according to one embodiment.

For illustrative purposes, codes 301 are shown herein in black on white background for readability and easier understanding. However, codes 301 can be made invisible to the human eye if desired. For example, in various embodiments, codes 301 may be visible only in the near infrared spectrum (NIR), in the IR (infrared) spectrum, or in the UV (ultra violet) spectrum, and may be completely invisible to the human eye. In at least one embodiment, this can be achieved using a combination of IR, NIR, and/or UV blocking ink and a matching IR, NIR, and/or UV light source.

Figure 11A:
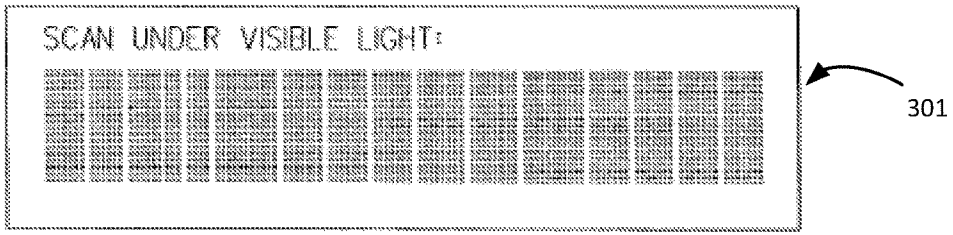
FIGS. 11A and 11B depict examples of scans of the codes on drivable surface segments, as detected by an imaging sensor on a mobile agent, using visible light and using near infrared (NIR) light, respectively, according to one embodiment.
Figure 11B:
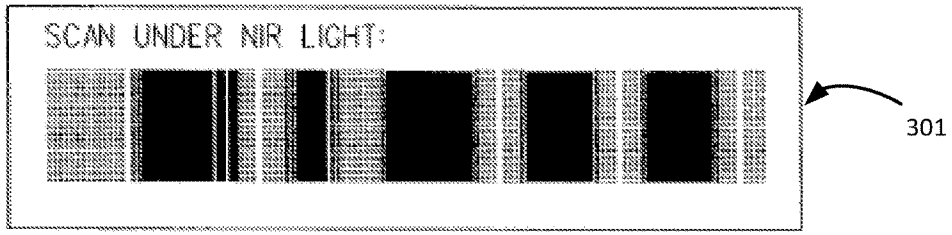

For example, codes 301 can be printed with an ink or dye that absorbs NIR light. The peak absorption frequency is approximately the same wavelength as that at which the LED light source 1007 of imaging system 1005 on mobile agent 104 emits light, such as for example 790 nm. A code 301 would therefore appear black to imaging system 1005 on mobile agent 104, while an area of surface 601 that does not contain a code 301 would appear white. Referring now to FIGS. 11A and 11B, there are shown examples of how a code 301 would appear under visible light (FIG. 11A) and under NIR light (FIG. 11B).

The mentioned wavelengths are of course only examples, and any CMOS sensor/LED/ink combination in the NIR/IR spectrum or even UV spectrum would work essentially the same way, and a variety of inks/dyes are available from numerous manufacturers like EPOLIN, MaxMax, and the like.

Figure 12:
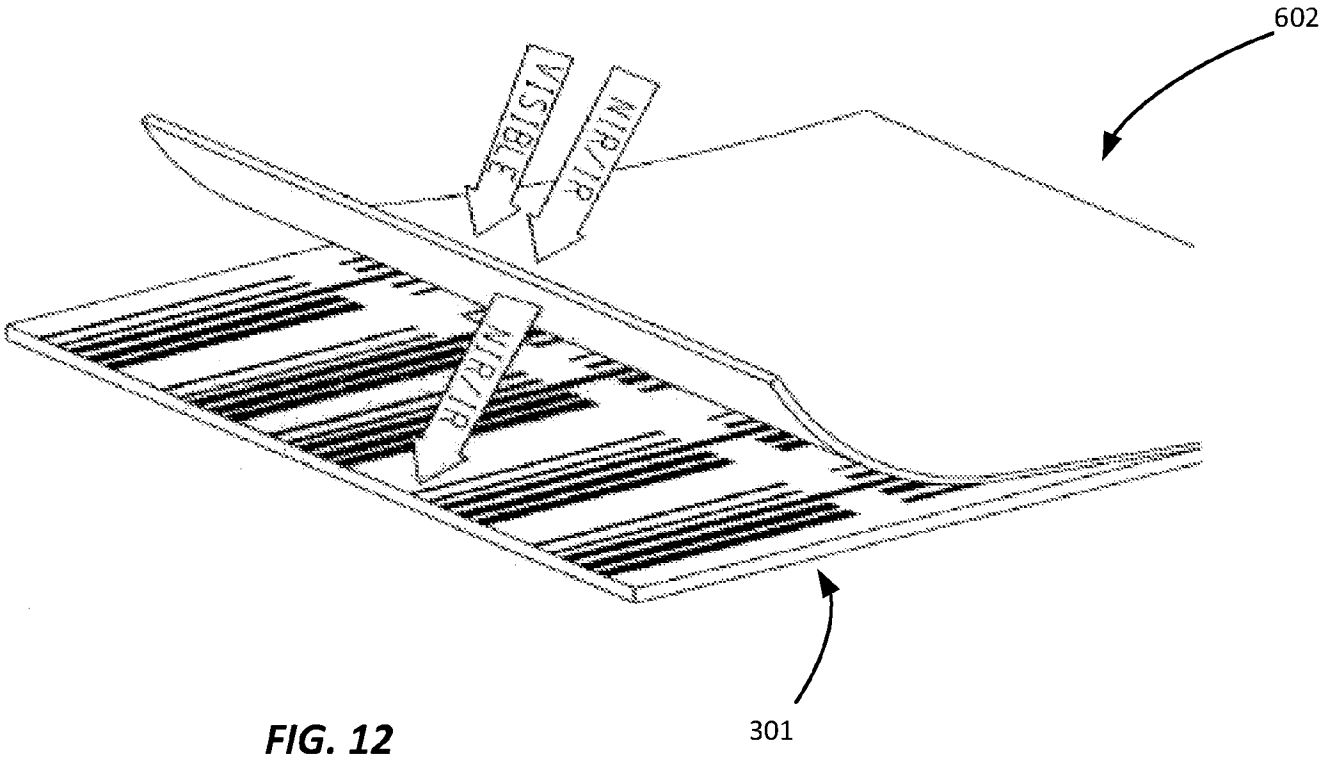
FIG. 12 depicts an example of machine-readable codes printed on a drivable surface segment such that the codes are visible to a sensor on a mobile agent but invisible to a human user.

Referring now to FIG. 12, there is shown an example of machine-readable codes 301 printed on a drivable surface segment 602 such that codes 301 are visible to a sensor (such as sensor 604 on a mobile agent 104) but invisible to a human user.

In general, codes 301 that are invisible to the human eye are desired so that drivable surface segments 602 can be made to have an appearance that more closely matches that of real roads. However, without changes in the hardware, the system can be implemented using visible ink (such as black), allowing users to print their own segments 602 on a standard printer without having to buy special cartridges.

Codes 301 can encode information such as the identity of segment 602 (e.g., straight, intersection, etc.), unique locations on segment 602, machine-readable codes 301A, and/or the like. In the example shown in FIG. 3, a center-line lane code 301A is provided at the center of the drivable lane to allow mobile agent 104 to steer within that lane. Additional codes 301 can encode an identifier for segment 602, and unique location(s) within segment 602.

The codes 301 depicted in FIG. 3 and elsewhere are merely exemplary, and are not to be construed as limiting; to the contrary, any suitable and/or desirable codes 301 (arranged in one or more rows or some other configuration(s)) can be utilized. Such codes 301 can include, for example, varying-thickness bars where each encodes a unique value. In the examples discussed herein, each bar of a code 301 is either thin or thick representing a 0 or 1 in a binary encoding of information; in other embodiments, other encoding schemes can be used, such as one in which the number of unique bar thicknesses can be variable to represent different values.

FIG. 3 also depicts an example of a single thicker bar 301B, referred to as a stop bar, to mark the completion of a segment 602 or portion of a segment 602.

In at least one embodiment, a type code 301 identifies a type of segment 602. Also included may be a location code 301 that encodes a unique location on that particular segment 602.

Figure 4:
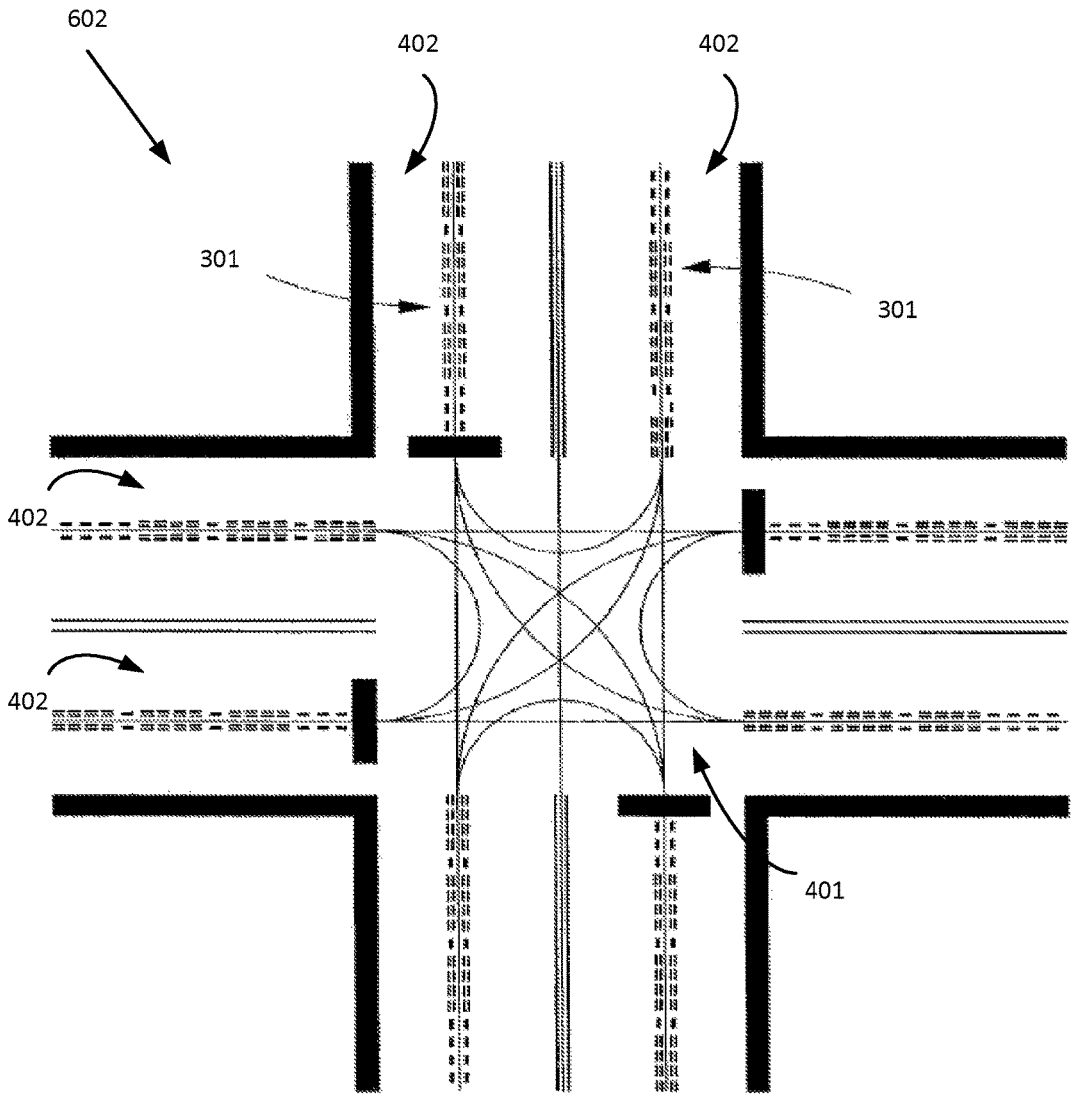
FIG. 4 depicts an example of a drivable surface segment having a four-way intersection, including machine-readable codes according to one embodiment.

Referring now to FIG. 4, there is shown an example of a drivable surface segment 602 that includes a four-way intersection 401, including various machine-readable codes 301 according to one embodiment. Segment 602 includes multiple lanes 402, wherein each lane 402 includes codes 301. Thus, each mobile agent 104 can easily identify the lane 402 on which it is currently driving.

In at least one embodiment, some of the information encoded in codes 301 can be interpreted directly by mobile agent 104, while other information may be relayed back to host device 108. Host device 108 interprets codes 301 parsed by mobile agent 104, and has an internal (virtual) representation of drivable surface 601 and the various segments 602 therein. This allows host device 108 to identify positions of mobile agents 104 on drivable surface 601, and to consider this position and the positions of other mobile agents 104 (and other features or objects) on drivable surface 601 in its commanded behaviors of mobile agent 104. This also allows future expansion or custom-built segments 602 with only small software updates to host device 108 rather than having to also update each mobile agent 104.

Figure 5:
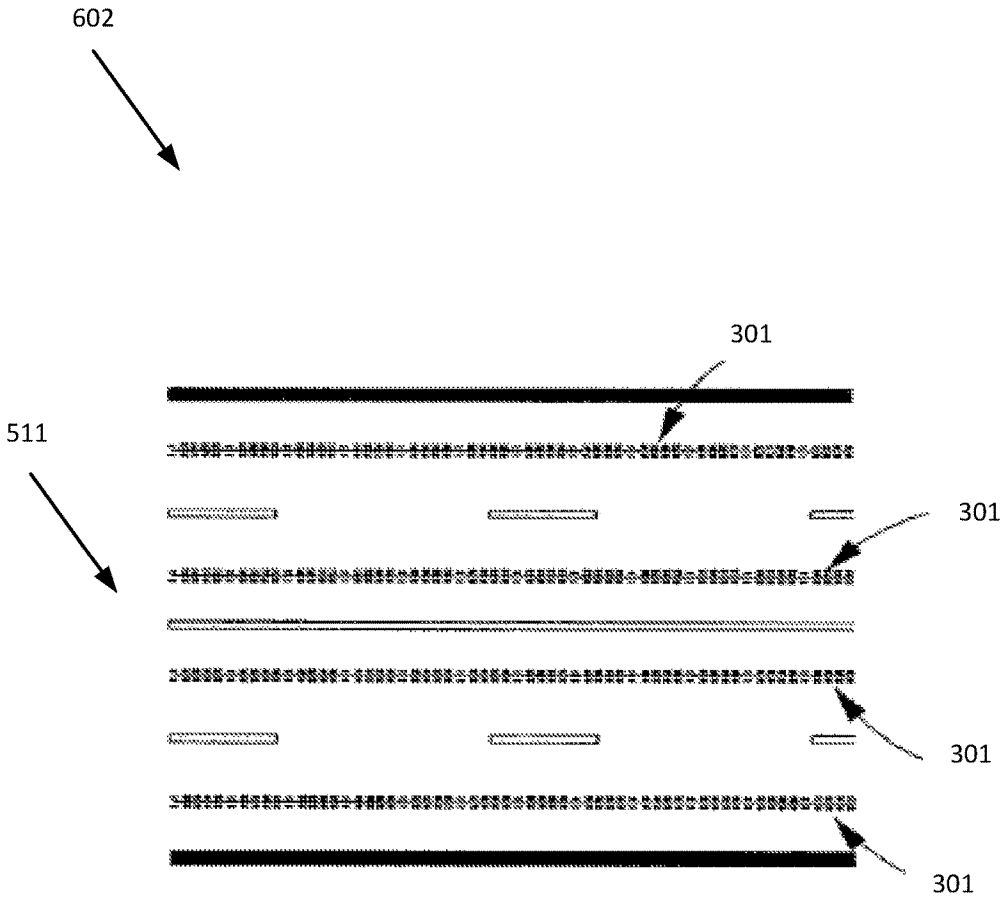
FIG. 5 depicts an example of a drivable surface segment having a multi-lane straight road, including machine-readable codes according to one embodiment.

Referring now to FIG. 5, there is shown an example of a drivable surface segment 602 having a multi-lane straight road 511, including machine-readable codes 301 to provide information as to the locations of various lanes on road 511, according to one embodiment.

Figure 6:
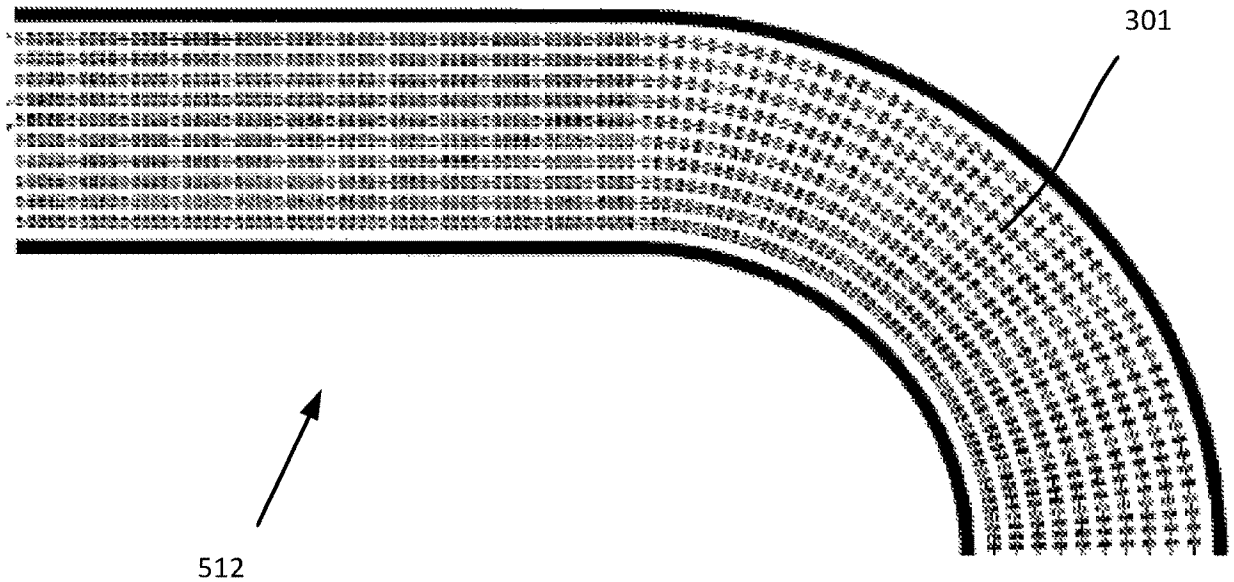
FIG. 6 depicts an example of a drivable surface segment having a multi-lane curved road, including machine-readable codes according to one embodiment.

Referring now to FIG. 6, there is shown an example of a drivable surface segment having a multi-lane curved road 512, including machine-readable codes 301 to provide information as to the locations of various lanes on road 512, according to one embodiment.

Codes 301 serve several purposes. First, codes 301 allow mobile agents 104 to identify the segment 602 type that they are on during exploration, as described in more detail below. Furthermore, codes 301 allow the encoding of various parameters, such as the curvature direction of a segment 602 upon entering a new segment 602, thus enabling mobile agents 104 to better handle control-related challenges. Additionally, codes 301 provide position estimates at sufficiently fine resolutions to allow host device 108 to create high-level plans and interactive behaviors for mobile agents 104. Finally, each mobile agent 104 is able to accurately maintain a heading within a lane using a center-line code such as code 301A, and to estimate its speed and acceleration using the periods of time for which codes 301 are visible or not visible since the precise lengths of the bars and spaces between them are known.

EXAMPLES

Figure 13:
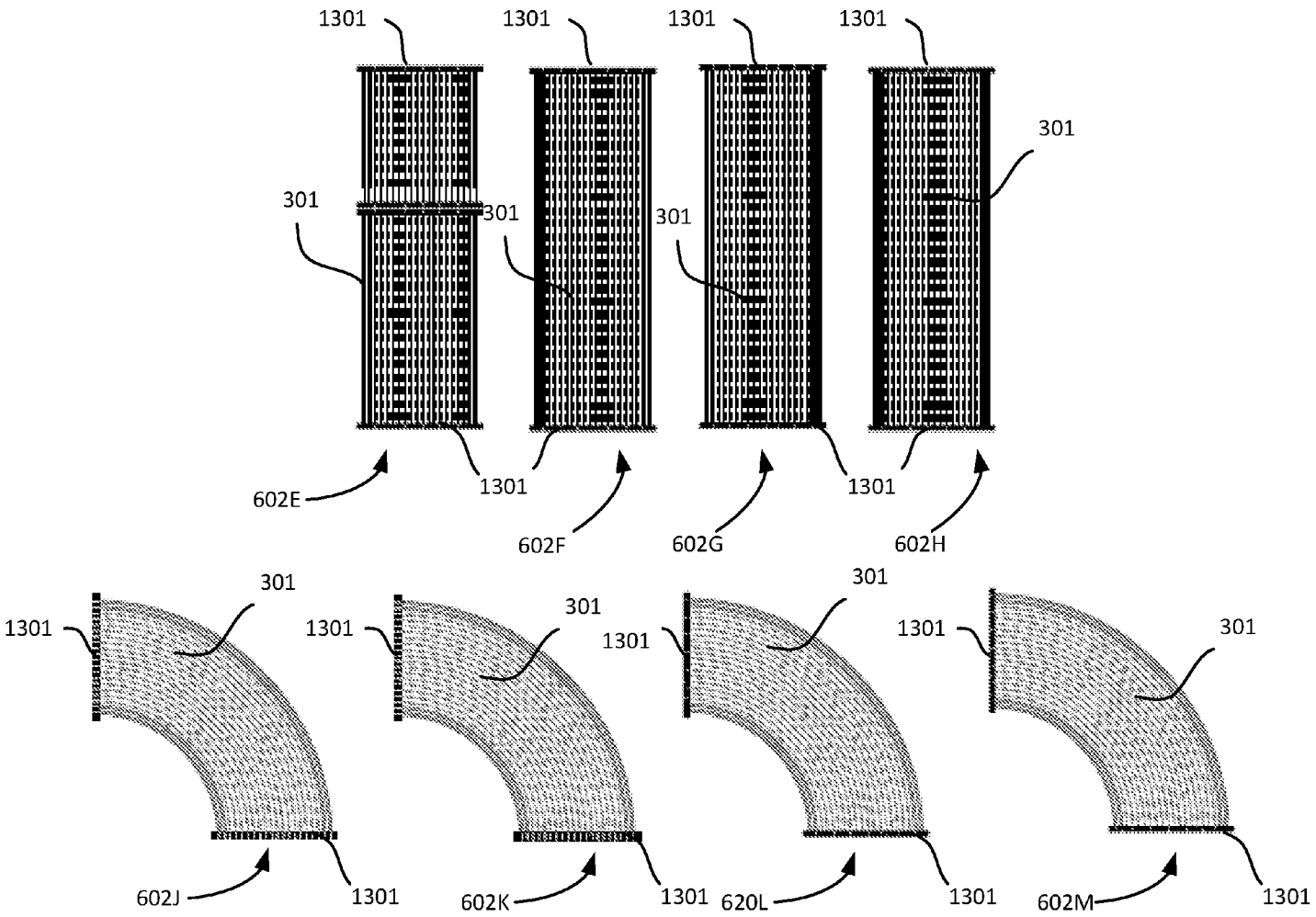
FIG. 13 depicts examples of various types of modular drivable surface segments containing machine-readable codes, according to one embodiment.

Referring now to FIG. 13, there are shown several examples of various types of modular drivable surface segments 602 containing machine-readable codes 301, according to one embodiment. In at least one embodiment, each code 301 is a 7-bit code, although any other suitable code length can be used. In at least one embodiment, straight segments 602 (such as segments 602E to 602H) are 560 mm in length, and curved segments 602 (such as segments 602J to 602M) are 280 mm in radius. One skilled in the art will recognize that other dimensions can be used.

In at least one embodiment, each segment 602 contains a transition bar 1301 at each entry and exit point. Transition bar 1301 is a particular machine-readable code 301 that indicates, to mobile agents 104, that they are entering or exiting a segment 602.

In at least one embodiment, some segments 602 may contain codes 301 representing obstacles or other features. Host device 108 can interpret such codes 301 as appropriate to the virtual environment. In response to a mobile agent 104 driving on such an obstacle or feature, a particular effect may be applied, for example to change the way mobile agent 104 behaves. For example, code 301 may represent an oil slick that adversely affects steering; therefore, after driving over code 301, mobile agent 104 may behave in such a manner that simulates impaired steering. Other codes 301 can provide a speed boost, or a maneuverability boost, or may act to impair movement in some manner. In at least one embodiment, such codes 301 may be pre-printed on segments 602, or they may be applied as a decal, sticker, or marking.

For some features, codes 301 are provided that can be read by mobile agent 104 regardless of current lane position. Such codes 301 can be reliably read and interpreted even when mobile agent 104 is not centered on a lane. In at least one embodiment, the following encoding patterns can be used to accomplish this goal (each containing five lines):

thin, thin, thin, thin, thin (A)
thin, thin, Stop, thin, thin (B)
thick, thick, thin, thick, thick (C)
thick, thick, Stop, thick, thick (D)

In at least one embodiment, multiple patterns can be used on the same segment 602, to encode additional information.

Figure 14:
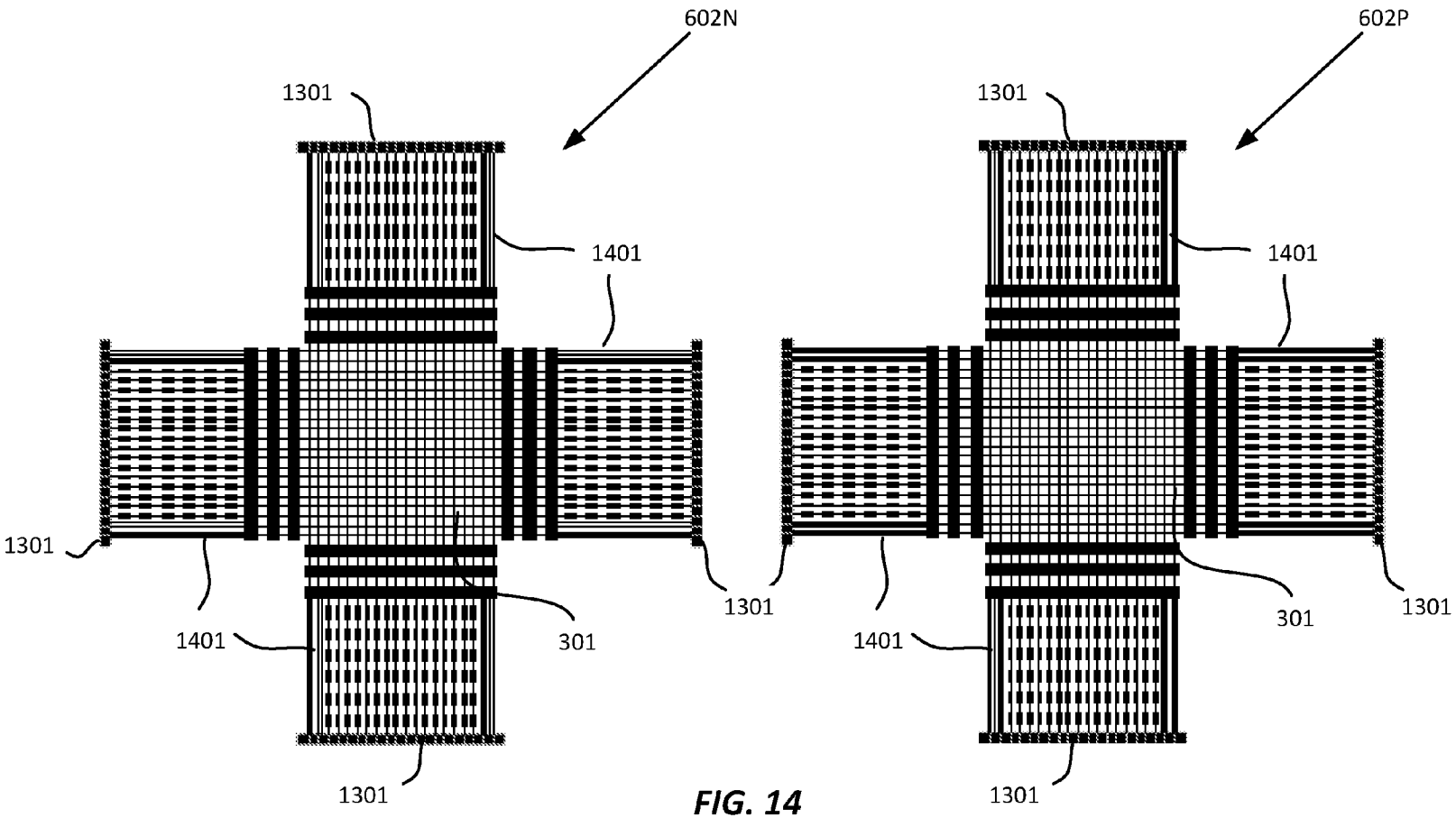
FIG. 14 depicts examples of intersection segments containing machine-readable codes, according to one embodiment.

Referring now to FIG. 14, here are shown examples of intersection segments 602N, 602P containing machine-readable codes 301, according to one embodiment. In at least one embodiment, these segments 602N, 602P each contain four unique sets of codes 301 corresponding to the four branches 1401 of segment 602N, 602P, and further indicating lane position within a particular branch 1401. By reading these codes 301, a mobile agent 104 can thereby identify which branch 1401 it used to enter or leave segment 602N, 602P, and can also determine which lane it is in. In at least one embodiment, these codes 301 follow an A-X-A pattern to denote a particular branch 1401, where the middle "X" could be any one of four unique patterns.

In at least one embodiment, when a mobile agent 104 encounters an intersection segment 602N, 602P, the mobile agent 104 can either turn or go straight. The decision may be automated, or up to user control. For example, in at least one embodiment, if mobile agent 104 is in the right hand lane when entering the intersection, it turns right; alternatively, it turns right if the user (or host device 108) commands it to.

In at least one embodiment, other types of intersections can be implemented, such as, for example, a T-intersection (not shown). In at least one embodiment, upon encountering a T-intersection, the mobile agent 104 can turn in one direction or the other (or go straight if traveling on the straight part of the T), depending on which lane it is in or depending on explicit commands from the user or from host device 108.

Another example is a Y-intersection (not shown), wherein one side veers to the right and the other veers to the left. In at least one embodiment, upon encountering a T-intersection, the mobile agent 104 can veer in one direction or the other, depending on which lane it is in or depending on explicit commands from the user or from host device 108.

Figure 15:
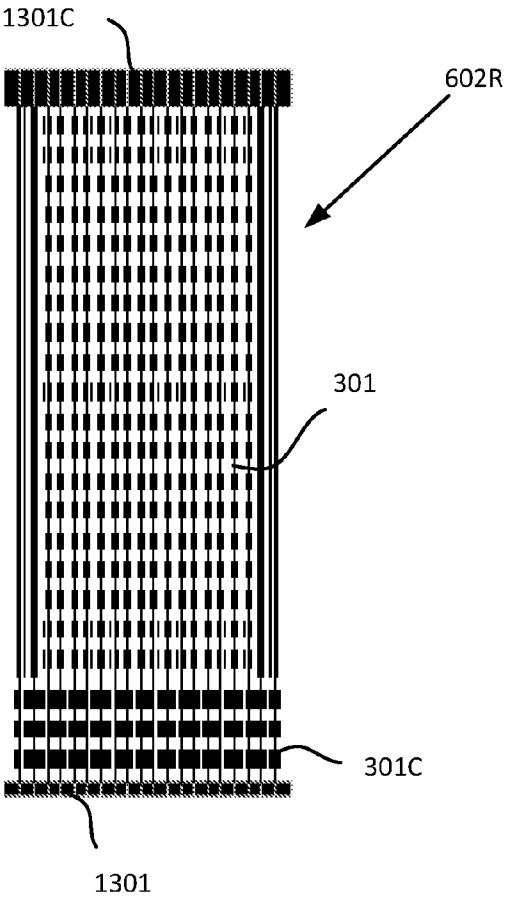
FIG. 15 depicts examples of jump segments containing machine-readable codes, according to one embodiment.
Figure 15:
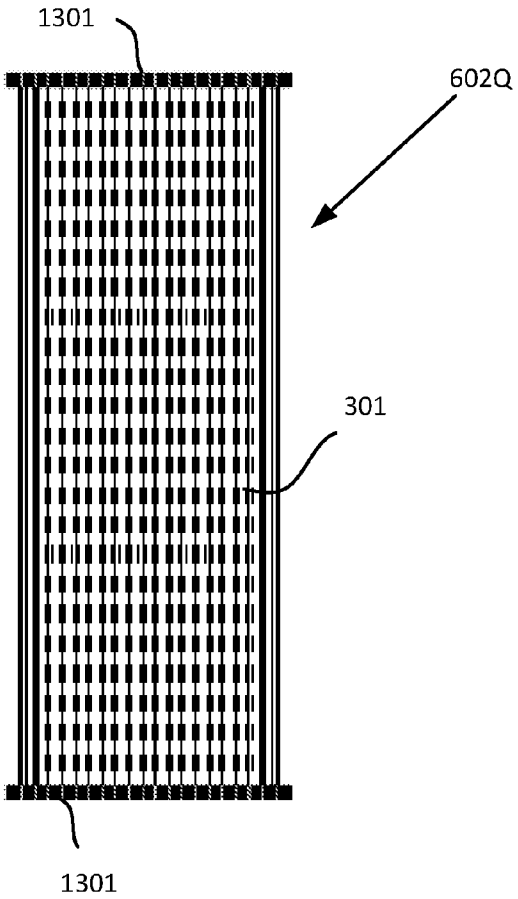
Figure 25:
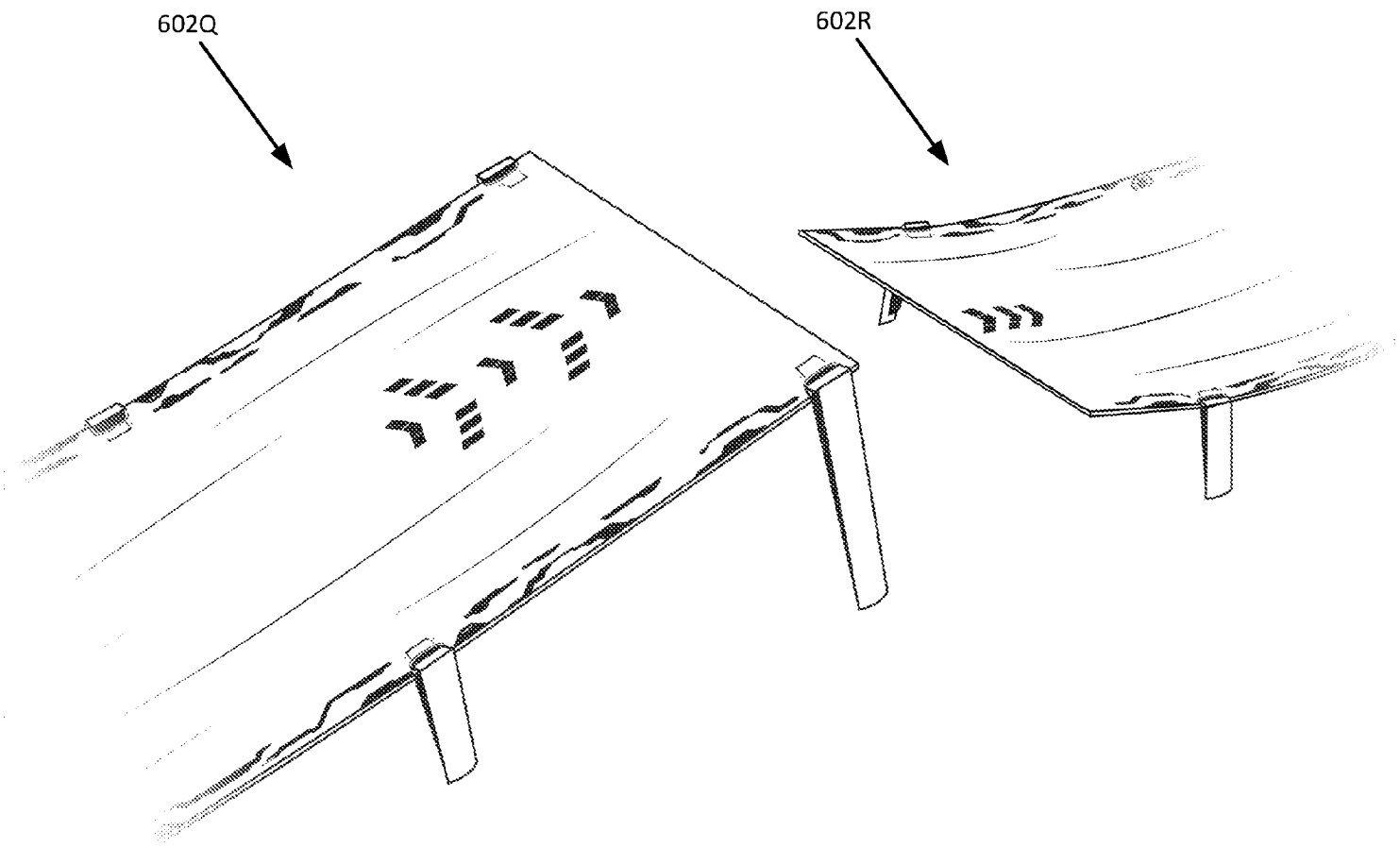
FIG. 25 depicts an oblique view of examples of jump segments, according to one embodiment.

Referring now to FIG. 15, there are shown examples of jump segments 602Q, 602R containing machine-readable codes 301, according to one embodiment. Referring now also to FIG. 25, there is shown an oblique view of jump segments 602Q, 602R, according to one embodiment. A jump segment 602Q, 602R is constructed so as to include a physical ramp element; a mobile agent 104 traveling along the segment is momentarily propelled into the air upon leaving the segment. For example, a riser can be placed under the exit end of the jump segment 602Q, 602R. In at least one embodiment, jump segments 602Q, 602R are similar to straight segments 602, except that they are unidirectional (i.e., they are intended to be traversed in one direction only). In at least one embodiment, one end of the segment 602 can have artwork indicating that it is the jump-off exit end. In at least one embodiment, transition bar 1301C at the jump-off exit end is thicker than normal, to indicate that mobile agent 104 should not enter segment 602R from that end. As shown in example segment 602R, on the entrance end of jump segment 602Q, 602R, a special code 301C can be positioned right after transition bar 1301 to indicate that this is a jump segment 602Q, 602R. In response to reading this code 301C, mobile agents 104 can be configured to automatically accelerate to the appropriate velocity in order to make the jump.

Of course a mobile agent 104 may react in any suitable manner up reading jump code 301C. For example, game logic or commands from host device 108 may indicate that mobile agent 104 should not accelerate in response to reading jump code 301C, for example if one of the following game logic conditions is true:

- mobile agent 104 does not have enough energy because it has been damaged (in the context of the game) or hit by enemies;
- mobile agent 104 did not apply enough throttle;
- the player controlling mobile agent 104 did not complete an objective.

The action to be taken in response to a jump code 301C can also be defined freely. For example, in response, mobile agent 104 might:

- accelerate and make the jump;
- turn around;
- simulate an attempt to make the jump, but deliberately fail, in a controlled manner.

Other actions are possible.

In at least one embodiment, the system can detect statistics and elements about the jump, and inform/penalize/reward the user accordingly. For example, the system can detect any or all of the following:

- airtime (detected, for example, by the length of time that sensor 604 on mobile agent 104 does not see codes 301, indicating that it is not in contact with a segment 602);
- jump distance (detected, for example, by encoder count to reach next segment 602 after landing);
- launch speed;
- launch angle.

Figure 16:
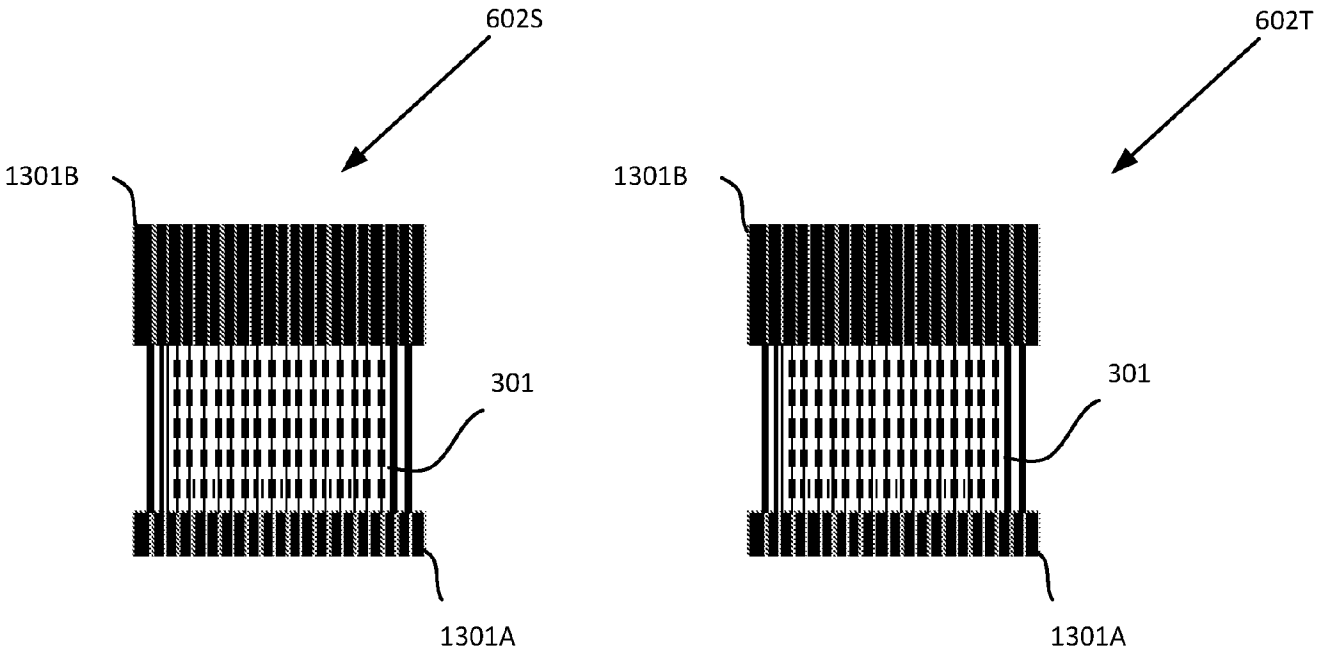
FIG. 16 depicts examples of turnaround segments containing machine-readable codes, according to one embodiment.

Referring now to FIG. 16, there are shown examples of turnaround segments 602S, 602T containing machine-readable codes 301, according to one embodiment. In a turnaround segment (such as 602S, 602T) two transition bars 1301A, 1301B provide a code to identify segment 602S, 602T as a turnaround segment. In the depicted example, shorter transition bar 1301A indicates the entrance end of turnaround segment 602S, 602T, and the dead-end is indicated by longer transition bar 1301B, meant to be impassable by mobile agents 104. Thus, upon encountering shorter transition bar 1301A, mobile agent 104 responds accordingly, for example by slowing down so as not to crash into the dead-end. Upon encountering the dead-end (i.e. longer transition bar 1301B), mobile agent 104 responds accordingly, for example by turning around.

In at least one embodiment, one side of turnaround segment 602S, 602T has a slightly different code offset than the other. This informs mobile agent 104 which half of the segment 602 the mobile agent 104 is driving on, and which direction it should turn to remain on segment 602. In other words, it tells mobile agent 104 whether to make a U-turn to the right or the left, depending on mobile agent's 104 current horizontal position (lane position). In at least one embodiment, codes 301 on turnaround segment 602S, 602T are also designed so that when parsed in reverse (on the way back out after turning), the code 301 appears different so it will not be misinterpreted to cause mobile agent 104 to turn around again.

One skilled in the art will recognize that many other types of segments 602 can be provided, in any modular fashion to operate in connection with one another and/or with the above-listed segments 602. Examples include a vertical looping segment 602 or corkscrew segment 602, containing a code 301 that tells mobile agent 104 to speed up so as to gain sufficient speed to complete the loop or corkscrew. As with the jump segment 602Q, 602R, statistics can be collected about the mobile agent's 104 performance on the loop or corkscrew. Another example is a half-pipe segment, that allows a mobile agent 104 to travel up a curved wall and back down again while traversing the segment 602, in a manner similar to a half-pipe snowboard or ski event.

Virtual Environment

As described in the above-referenced related U.S. Utility Applications, in at least one embodiment, basestation software, running on host device 108, operates a virtual version of the physical game that continuously maintains parity with events in the physical environment by updating stored information relating to mobile agent 104 position, direction, velocity, and other aspects characterizing game events. In at least one embodiment, host device 108 ensures that, at any point in time, the game states in the physical environment and the virtual environment are identical (or substantially identical), or at least that the game state in the virtual environment is a representation of the physical state to at least a sufficient degree of accuracy for gameplay purposes. Information provided by mobile agents 104 during exploration of drivable surface 601 can be used to generate and/or update the virtual environment.

For example, in at least one embodiment, if a user moves a segment 602 from one location to another, or otherwise reconfigures drivable surface 601, a mobile agent 104 that discovers the change (for example, by encountering a segment 602 in an unexpected location where previously there was a different segment 602 or no segment) transmits a signal describing the change to host device 108. Host device 108 can then update its virtual environment to reflect the change to the physical configuration of drivable surface 601. Such changes can therefore be detected by mobile agents 104 during normal game play, and not just during a separate exploration phase.

Exploration by Mobile Agents 104

It is desirable for host device 108 to know the exact structure of drivable surface 601. Since a user is free to reconfigure segments 602 at any time, there are a variety of techniques that enable host device 108 to identify the structure of drivable surface 601. In at least one embodiment, host device 108 determines the particular physical layout of segments 602 that currently make up the drivable surface 601 based on exploration of the physical layout of drivable surface 601 by one or more mobile agents 104. In performing such exploration, mobile agents 104 can act autonomously, or under the control of host device 108, according to various techniques described below. In at least one embodiment, mobile agents 104 operate in a coordinated manner to perform such exploration; in another embodiment, they operate independently. Mobile agents 104 may communicate information regarding the physical layout of the drivable surface to host device 108 using any suitable communications means, such as by wireless communication.

In other embodiments, host device 108 may obtain information about the physical layout of drivable surface 601 by other means, such as for example: a definition file accessible to host device 108; or a bus system of drivable surface 601 including a plurality of segments 602, wherein each segment 602 includes a bus segment (not shown) and a microcontroller (not shown) that communicates with host device 108 and with the microcontroller of each adjacent connected segment 602 via the bus segment.

Figure 7:
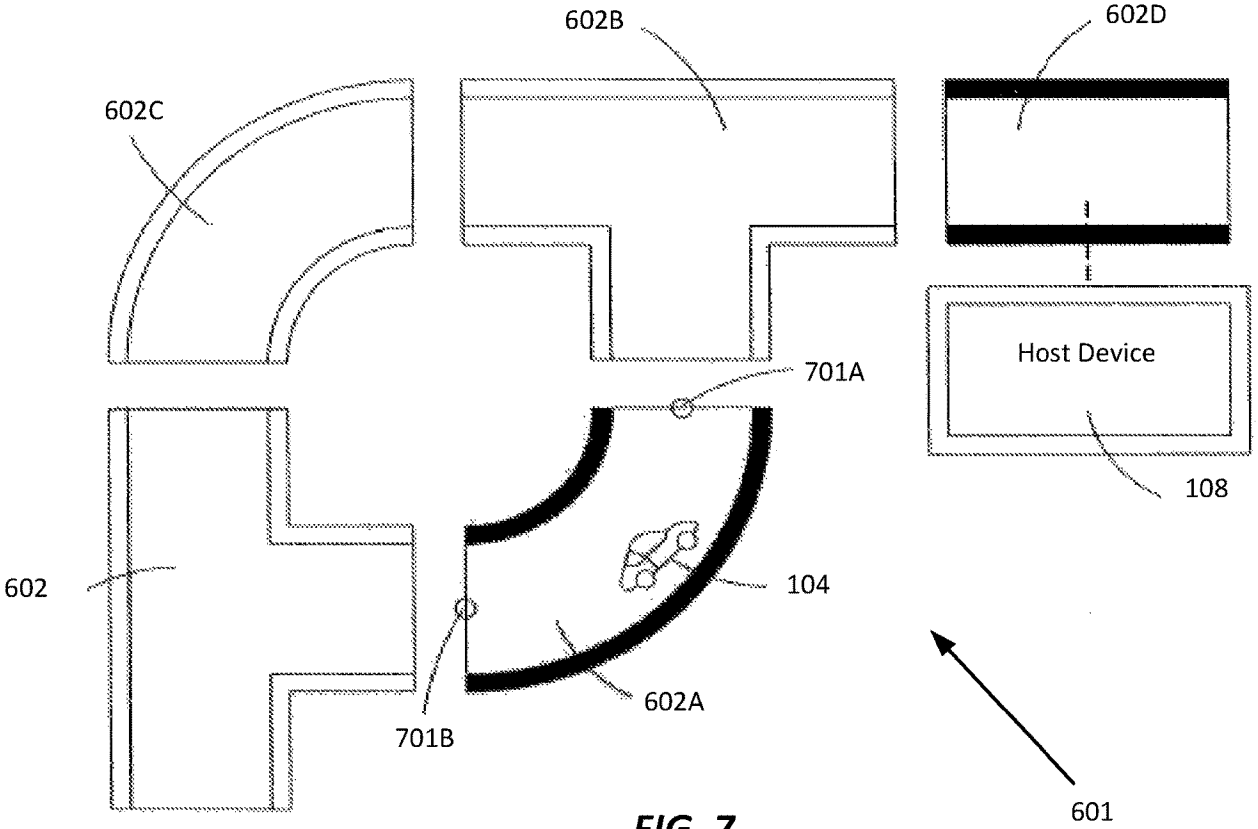
FIGS. 7 to 9 depict an example of exploration of drivable surface segments 602 by mobile agents 104, so as to discover the layout of drivable surface 601 according to one embodiment.
Figure 8:
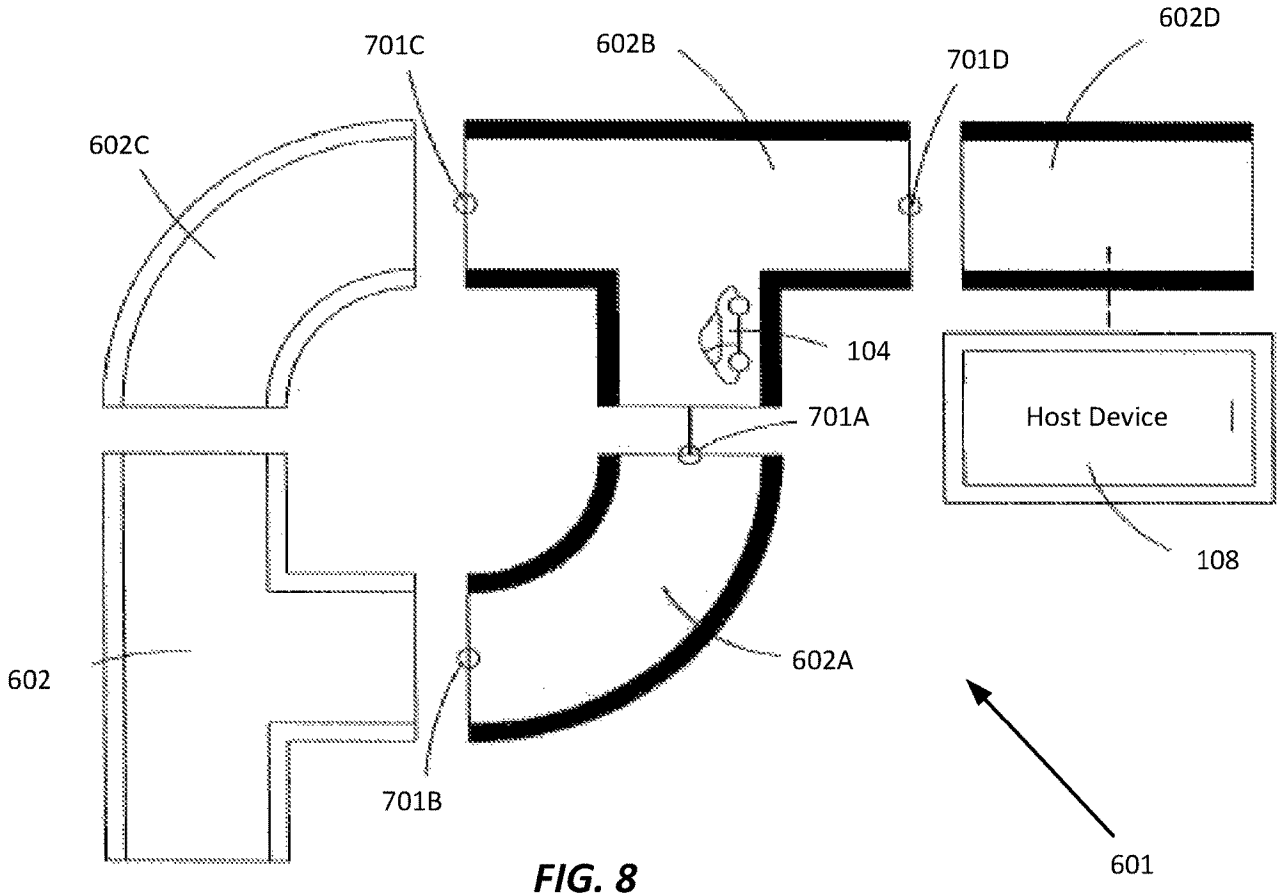
Figure 9:
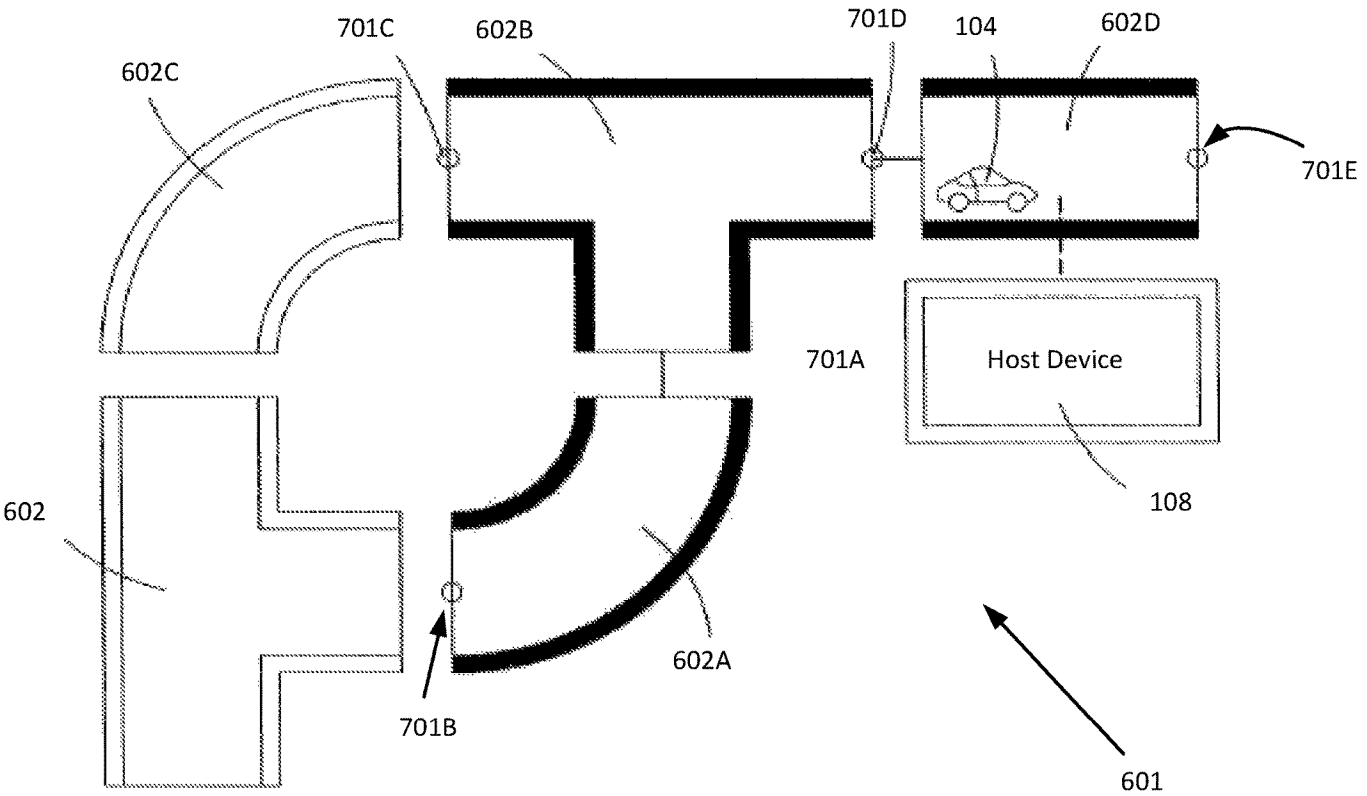

The following description provides additional details for an embodiment wherein host device 108 discovers the layout of drivable surface 601 based on exploration by mobile agents 104. Referring now to FIGS. 7 to 9, there is shown an example. For clarity, codes 301 are not shown in FIGS. 7 to 9, however, it can be assumed that each segment 602 shown in these Figures has codes 301 that indicate its shape and orientation.

As mobile agent 104 drives from one segment 602 to another, it identifies each segment's 602 type, position, and orientation by reading codes 301 using its sensor(s) 604. From the information received from mobile agents 104, host device 108 can generate and/or update its virtual representation of drivable surface 601.

In at least one embodiment, one or more mobile agent(s) 104 explore drivable surface 601 by systematically traveling to previously unexplored segments 602. This can take place autonomously, or under the direction of host device 108. In at least one embodiment, mobile agent(s) 104 perform this exploration by repeatedly planning and traversing paths through the closest unexplored exit until no unexplored exits remain.

In FIG. 7, the configuration of drivable surface 601 is initially unknown to host device 108. In the course of traversing segment 602A, mobile agent 104 reads codes 301 (not shown in FIG. 7) on segment 602A and transmits information to host device 108, allowing host device 108 to identify segment 602A. In at least one embodiment, mobile agent 104 notes the existence of two unexplored connection points 701A, 701B, for future exploration.

In FIG. 8, mobile agent 104 traverses connection point 701A (either autonomously or under the direction of host device 108), and moves onto segment 602B. This causes host device 108 to now know that segments 602A and 602B are connected to one another, and to know their relative orientation. Host device 108 is also made aware of two new unexplored connection points 701C and 701D, to segments 602C and 602D, respectively.

In FIG. 9, mobile agent 104 traverses connection point 701D (either autonomously or under the direction of host device 108), and moves onto segment 602D. This causes host device 108 to now know that segments 602B and 602D are connected to one another, and to know their relative orientation. Host device 108 is also made aware of one new unexplored connection point 701E. In at least one embodiment, this approach continues until no unexplored connections remain.

Figure 17:
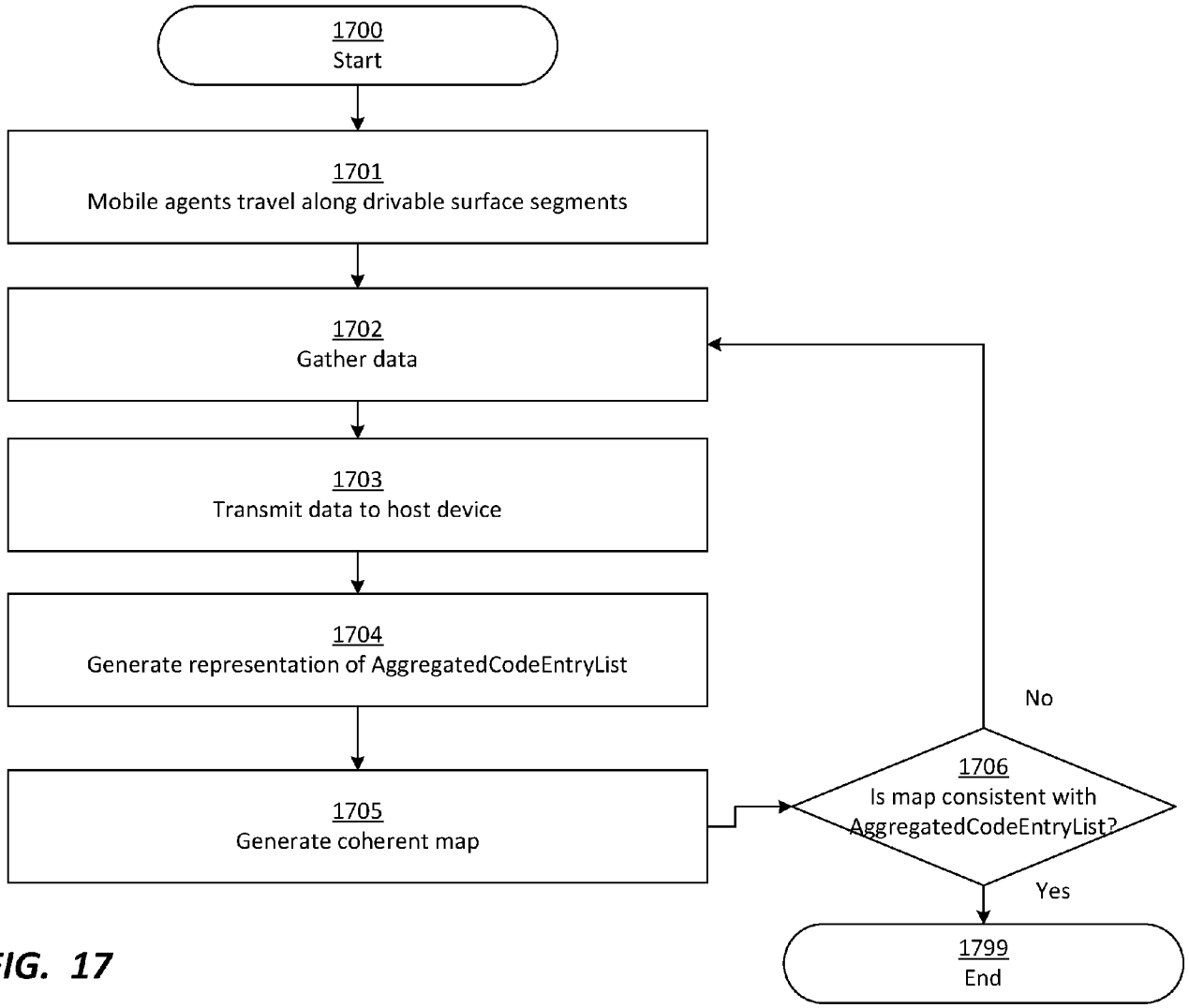
FIG. 17 is a flow diagram depicting an overall method of generating a virtual representation of a drivable surface containing a plurality of segments, based on information collected by mobile agents exploring the surface.

Referring now to FIG. 17, there is shown a flow diagram depicting an overall method of generating a virtual representation of a drivable surface 601 containing a plurality of segments 602, based on information collected by mobile agents 104 exploring surface 601. The method depicted in FIG. 17 can be performed using the system architecture described herein, although one skilled in the art will recognize that the method can be performed using other systems and components as well.

The method begins 1700. One or more mobile agents 104 travel 1701 along drivable surface segments 602 in a systematic fashion, as described in more detail below. As they travel 1701, they gather 1702 data describing the drivable surface segments 602 and transmit 1703 the gathered data to host device 108. At host device 108, a representation of an "AggregatedCodeEntryList" is generated 1704, as described in more detail below. Then, the representation of the AggregatedCodeEntryList is incrementally augmented to generate 1705 a coherent map of drivable surface 601, using additional data received from mobile agent(s) 104. In step 1706, a determination is made as to whether the generated map is consistent with AggregatedCodeEntryList. If not, the method returns to step 1702. If the map is consistent, the method ends 1799.

Each of the steps depicted in FIG. 17 will now be described in more detail.

Figure 18:
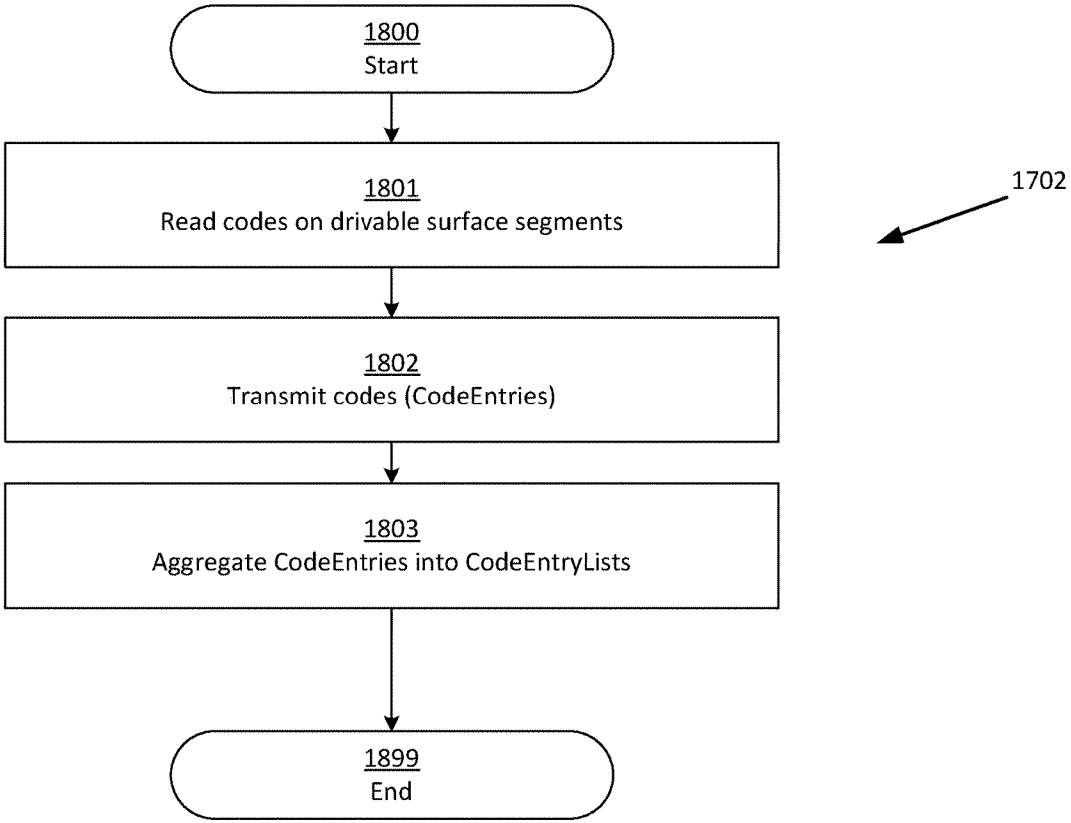
FIG. 18 is a flow diagram depicting a method of gathering data describing segments of a drivable surface, according to one embodiment.

Referring now to FIG. 18, there is shown a flow diagram depicting a method of gathering data 1702 describing drivable surface segments 602, according to one embodiment. The method begins 1800. As a mobile agent 104 travels 1701 along drivable surface segments 602, it attempts to read 1801 codes 301 on segments 602. In at least one embodiment, mobile agent 104 attempts to read a "pieceID" code 301 that identifies the type of segment 602. When such information has been read, mobile agent 104 transmits 1802 the segment 602 identifying code 301 to host device 108 or to a controller 101 such as a user's phone or other device. This transmission is referred to as a "CodeEntry". The receiving device, whether it is host device 108 or a controller 101, aggregates 1803 received CodeEntries for each mobile agent 103. The aggregated representation of CodeEntries for a particular mobile agent 103 is referred to as a "CodeEntryList", wherein each element in a CodeEntryList represents a CodeEntry corresponding to a drivable surface segment 602.

Accordingly, each CodeEntry is an internal representation of a drivable surface segment 602, and each CodeEntryList is an internal representation of a section of the overall drivable surface 601 (i.e., the map).

Figure 23:
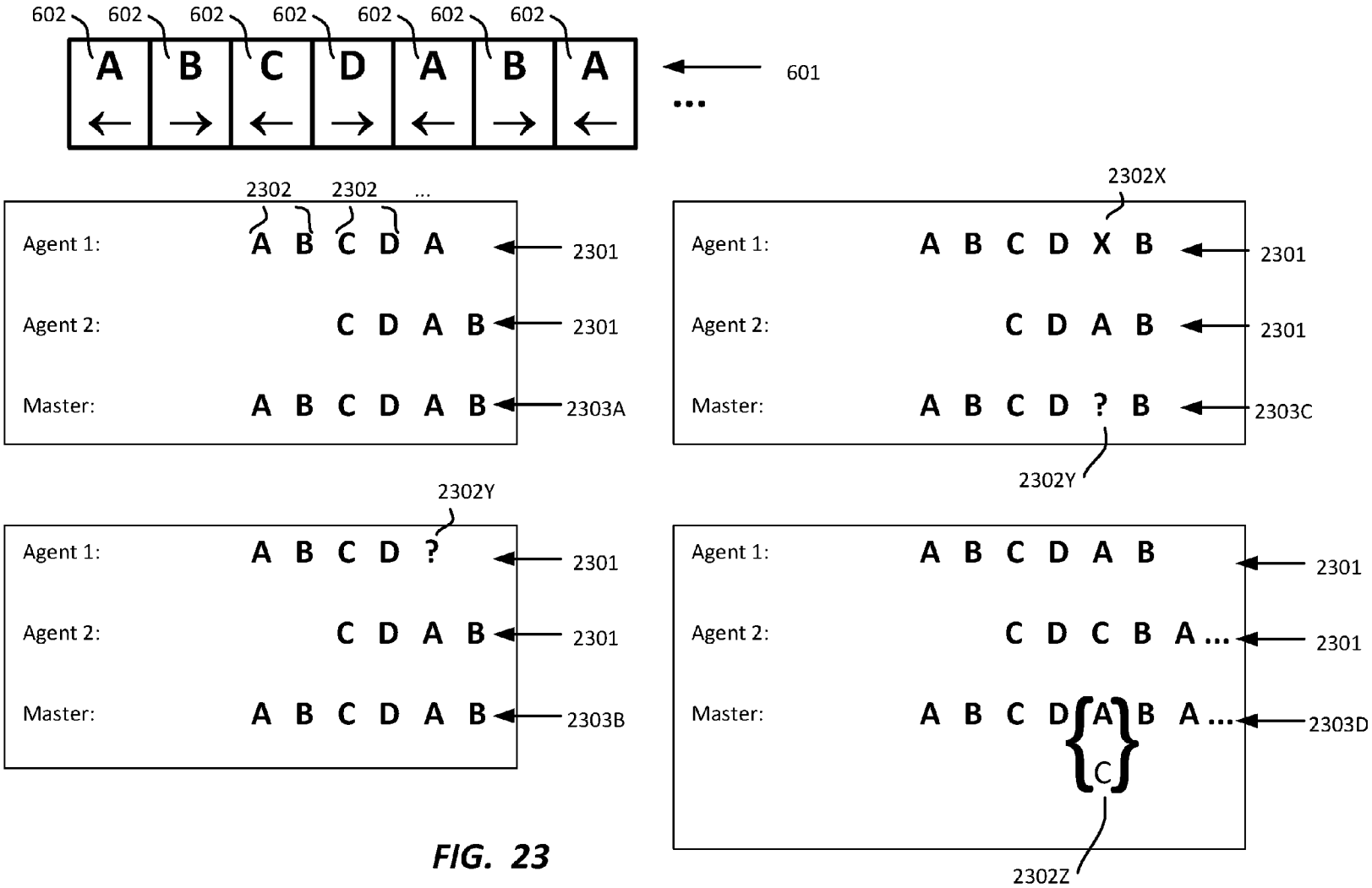
FIG. 23 depicts an example of an exploration process including building a map representing a drivable surface and merging information received from multiple mobile agents, according to one embodiment

Referring now also to FIG. 23, there is shown an example of the exploration process including building a map representing a drivable surface and merging information received from multiple mobile agents 104, according to one embodiment. Various CodeEntryLists 2301 are shown, with each CodeEntryList 2301 having a number of CodeEntries 2302 (indicated by letters such as A, B, C, or D). The different letters represent different codes 301 detected by particular mobile agents 104 as they drive on segments 602 of drivable surface 601 (map), and therefore represent different shapes or orientations of segments 602. CodeEntries 2302X (indicated as "X") represent misread data or missing data. CodeEntries 2302Y (indicated as "?") represent unknown data (such as those segments 602) that have not yet been traversed. In the example of FIG. 23, CodeEntryLists 2301 are labeled as being associated with "Agent 1" or "Agent 2", corresponding to the particular mobile agent 104 that collected that data. Also shown are AggregatedCodeEntryLists 2303, each representing an aggregation of data received during exploration by Agent 1 and Agent 2.

Figure 19:
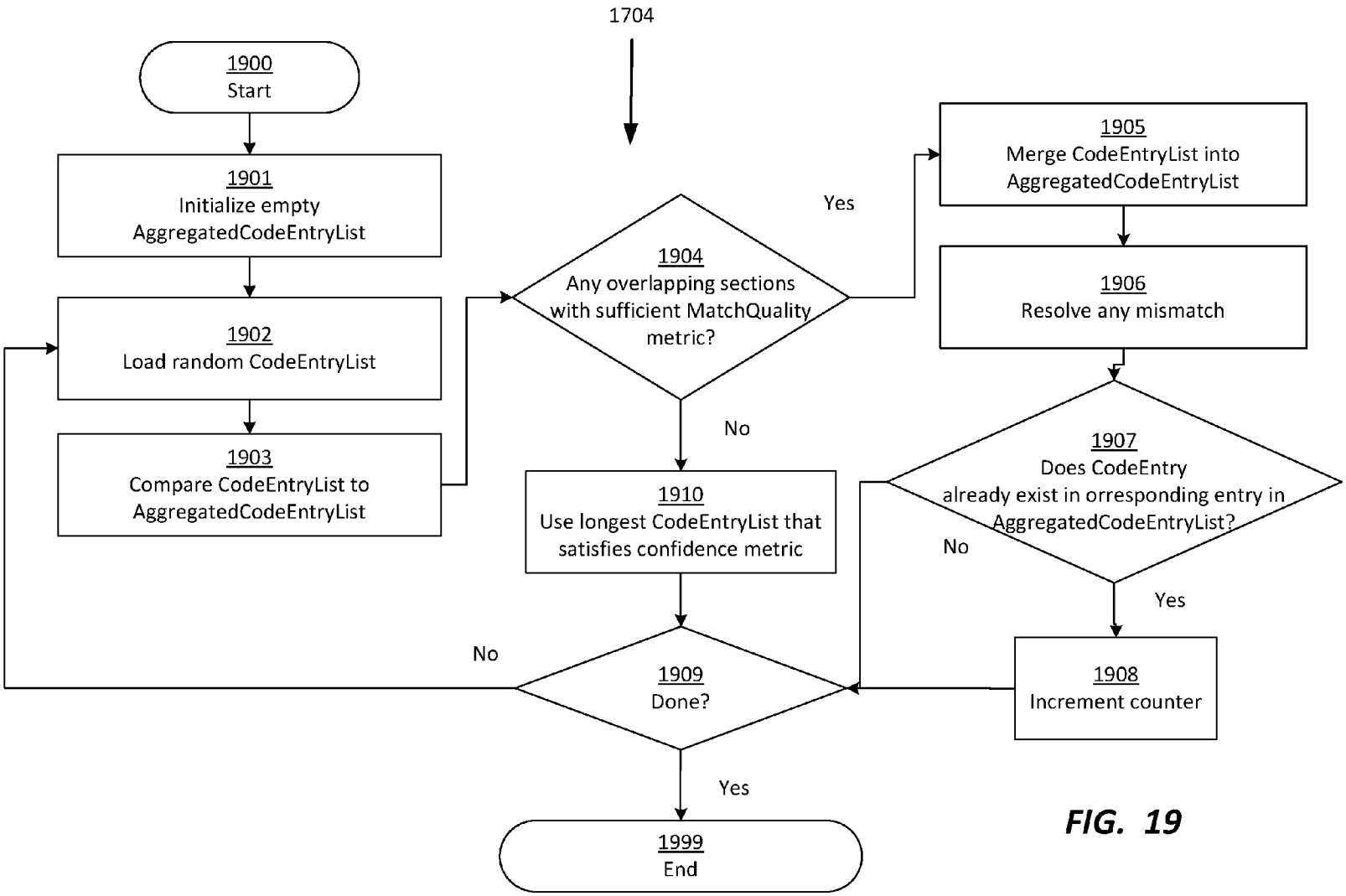
FIG. 19 is a flow diagram depicting a method of generating a representation of an AggregatedCodeEntryList of a drivable surface, according to one embodiment.

Referring now to FIG. 19, there is shown a flow diagram depicting a method of generating 1704 a representation of an AggregatedCodeEntryList of drivable surface 601, according to one embodiment. The AggregatedCodeEntryList represents an aggregation of data received during exploration, either by a single mobile agent 104 or by a plurality of mobile agents 104. In at least one embodiment, the steps of FIG. 19 are performed periodically, such as at regular intervals. Alternatively, the steps can be performed once a certain amount of data has been collected.

In at least one embodiment, the method begins by initializing 1901 an empty AggregatedCodeEntryList. A random CodeEntryList is loaded 1902 and compared 1903 with the AggregatedCodeEntryList. The comparison 1903 involves determining whether there is any overlap between the sections of the loaded CodeEntryList and the current AggregatedCodeEntryList. In at least one embodiment, comparison 1903 is performed using a metric (referred to as a MatchQuality metric) to determine a degree of similarity and reliability of the match. Any suitable metric can be used, such as for example a determination as to how many CodeEntries in the CodeEntryList match those of the current AggregatedCodeEntryList, as compared with how many CodeEntries would be a mismatch if the CodeEntryList were merged with the current AggregatedCodeEntryList.

If, based on the comparison step 1903, an overlap is found 1904 (with a sufficient MatchQuality metric), the rest of the CodeEntryList that is not already in the AggregatedCodeEntryList is merged 1905 into the AggregatedCodeEntryList. Any mismatch between the CodeEntryList and the AggregatedCodeEntryList is resolved 1906, for example, by holding multiple hypotheses for the element. In at least one embodiment, this means that at a given time, each element in the AggregatedCodeEntryList can be one of many different CodeEntries.

While merging the CodeEntryList into the AggregatedCodeEntryList, a determination is made 1907 as to whether each CodeEntry already exists in the corresponding entry in the AggregatedCodeEntryList. If so, then a counter for that CodeEntry is incremented 1908, indicating that a particular drivable surface segment 602 has been seen more than once. The counter thus indicates relative reliability of observed data.

If, in step 1904, there are no overlapping sections, the system uses 1910 the longest CodeEntryList that satisfies a confidence metric as the AggregatedEntryList. One such metric is the ratio of unknown/missing data to number of CodeEntries being below a threshold. In at least one embodiment, all other CodeEntryLists are retained for the next time step 1704 (generate representation of AggregatedEntryList) is performed.

Once the AggregatedCodeEntryList is generated 1909 (for example, if all CodeEntryLists have been processed), the method ends 1999. As described above, if in step 1706, no map is consistent with the generated AggregatedCodeEntryList, the method returns to step 1702 to gather more data.

Referring again to FIG. 23, there are shown examples of AggregatedCodeEntryLists 2303. In AggregatedCodeEntryList 2303A, the data collected by Agent 1 and Agent 2 agree, so that AggregatedCodeEntryList 2303A represents a simple aggregation of the collected data. In AggregatedCodeEntryList 2303B, one CodeEntry 2302Y represents unknown data collected by Agent 1, so the corresponding data from Agent 2 ("A") is used. In AggregatedCodeEntryList 2303C, one CodeEntry 2302X represents misread data collected by Agent 1, so the corresponding entry 2302Y in AggregatedCodeEntryList 2303C is indicated as unknown. In AggregatedCodeEntryList 2303D, conflicting data has been received for CodeEntry 2302Z; therefore more than one hypothesis is being held for that CodeEntry 2302Z. Since "A" and "C" have each been observed once, there is currently a tie, and more data collection is needed to decide which hypothesis to use. In at least one embodiment, in such a situation, host device 108 can dispatch another mobile agent 104 to collect additional data and resolve the conflict; in another embodiment, the system simply waits until such additional data becomes available.

Figure 20:
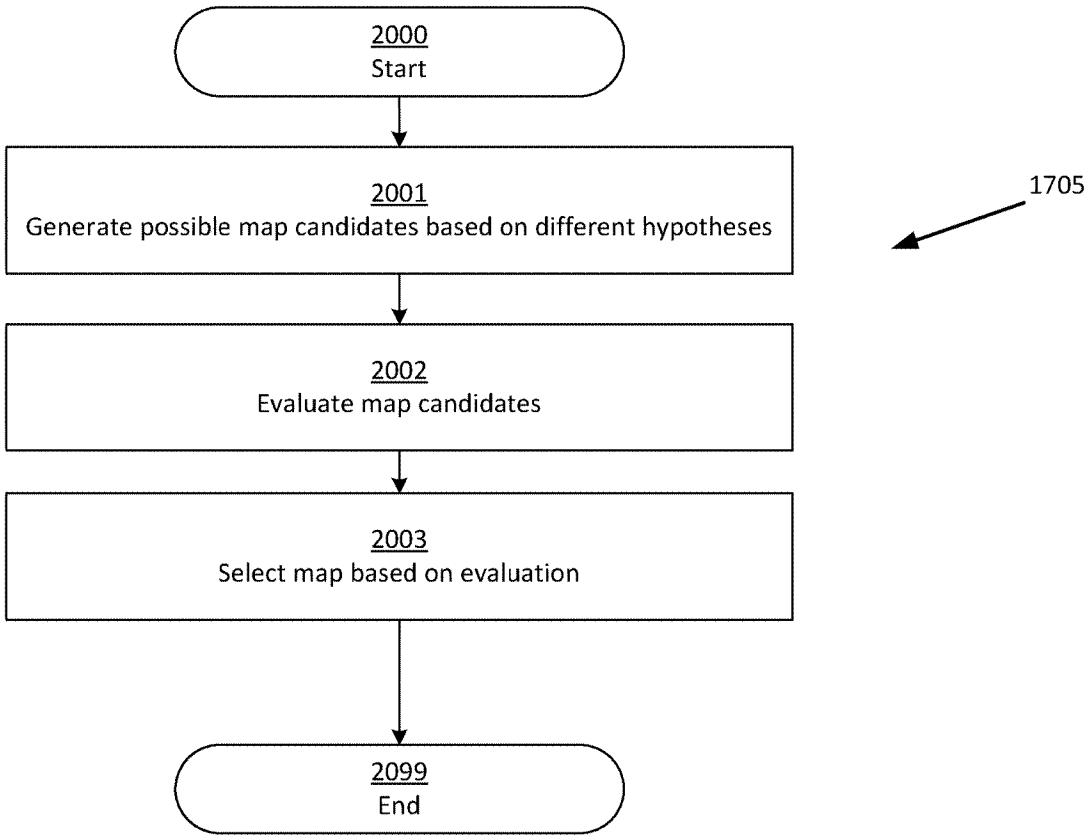
FIG. 20 is a flow diagram depicting a method of generating a coherent map based on a set of AggregatedCodeEntryLists for a drivable surface, according to one embodiment.

Referring now to FIG. 20, there is shown a flow diagram depicting a method of generating 1705 a coherent map based on a set of AggregatedCodeEntryLists for drivable surface 601, according to one embodiment. In at least one embodiment, the map is a virtual representation of the drivable surface 601, stored for example as a CodeEntryList that satisfies various requirements (such as being a full loop, having no unconnected drivable segments 602, and/or the like.) In at least one embodiment, the drivable surface is stored in the virtual representation as an object, referred to as RoadNetwork.

First, a set of possible map candidates (represented as CodeEntryLists) is generated 2001, by generating all combinations of different hypotheses for all AggregatedCodeEntryLists 2302 having more than one hypothesis. In at least one embodiment, this is a combinatorial approach.

The various map candidates are evaluated 2002, based on a set of criteria. Such criteria can include, for example:

- the likelihood that the map candidate is correct, given the observations in the hypotheses; for example, for each element in each AggregatedCodeEntryList 2302, those CodeEntries with more observations are considered to have a higher likelihood; and
- the degree to which the map candidate satisfies the specified requirements.

A map candidate is selected 2003 based on the evaluation. The method then ends 2099.

Figure 21:
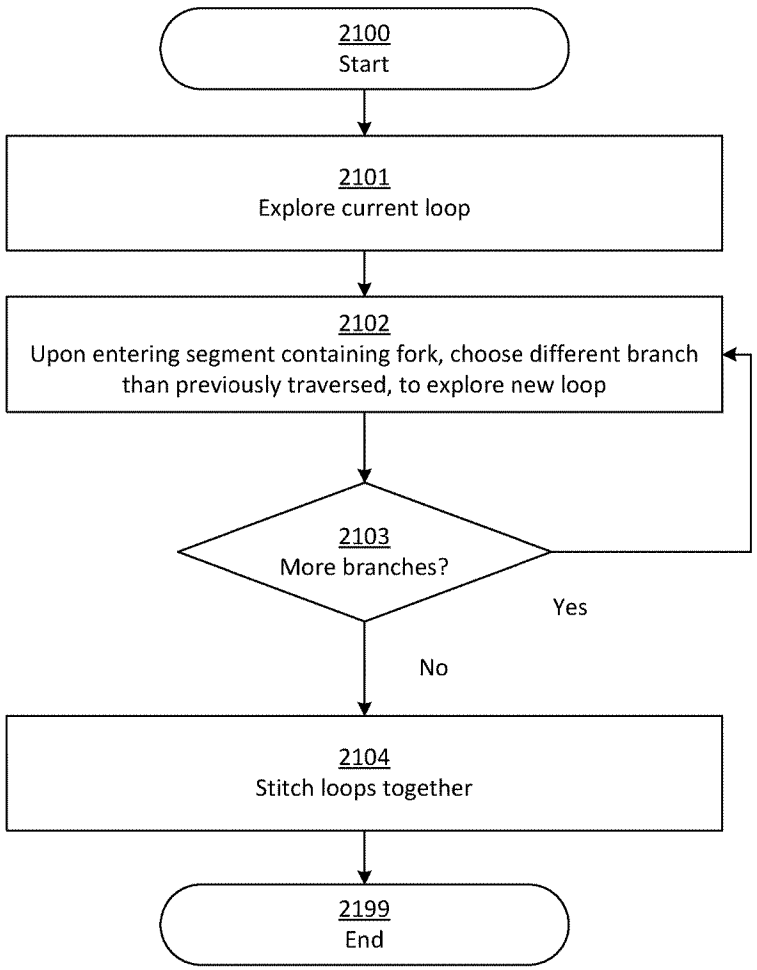
FIG. 21 is a flow diagram depicting a method of exploring multiple branches of a map representing a drivable surface, according to one embodiment.

Referring now to FIG. 21, there is shown a flow diagram depicting a method of exploring multiple branches of a map representing a drivable surface 601, according to one embodiment. This method is used, for example, when, during exploration, mobile agents 104 encounter forks with two or more branches. The depicted method provides a technique by which the entire drivable surface 601 can be traversed so that a complete and accurate map can be generated. The depicted method can be performed using one mobile agent 104 or a plurality of mobile agents 104.

If a fork is encountered with different branches, the current loop is explored first 2101. This may mean, for example, instructing mobile agent 104 to continue driving forward until it has either hit a dead-end, or returned to its starting position. The return to starting position can be detected because the AggregatedCodeEntryList would generate a map with a closed loop.

Then, the next time a mobile agent 104 enters a drivable surface segment 602 containing a fork, it is instructed to choose 2102 a different branch than was previously traversed. This leads mobile agent 104 to a different loop, which it then explores.

The mobile agent 104 that explores the new loop in step 2102 may be, but need not be, the same mobile agent 104 that explores the current loop in step 2101. For example, two (or more) different mobile agents 104 can concurrently explore different loops concurrently, thus increasing the efficiency of overall exploration of drivable surface 601.

If any more branches are encountered 2103, the method returns to step 2102.

Once all branches have been explored, the various loops are stitched together 2104. In at least one embodiment, this is done by examining the possible branch points (Piece A in this case) and matching the CodeEntries related to the branch point. In this case, we know how CodeEntriesLists 2401A and 2401B are related to each other from the CodeEntries of Piece A and the system's understanding of the structure of piece A. In at least one embodiment, this results in a set of AggregatedCodeEntryLists that are related to one another.

Figure 24:
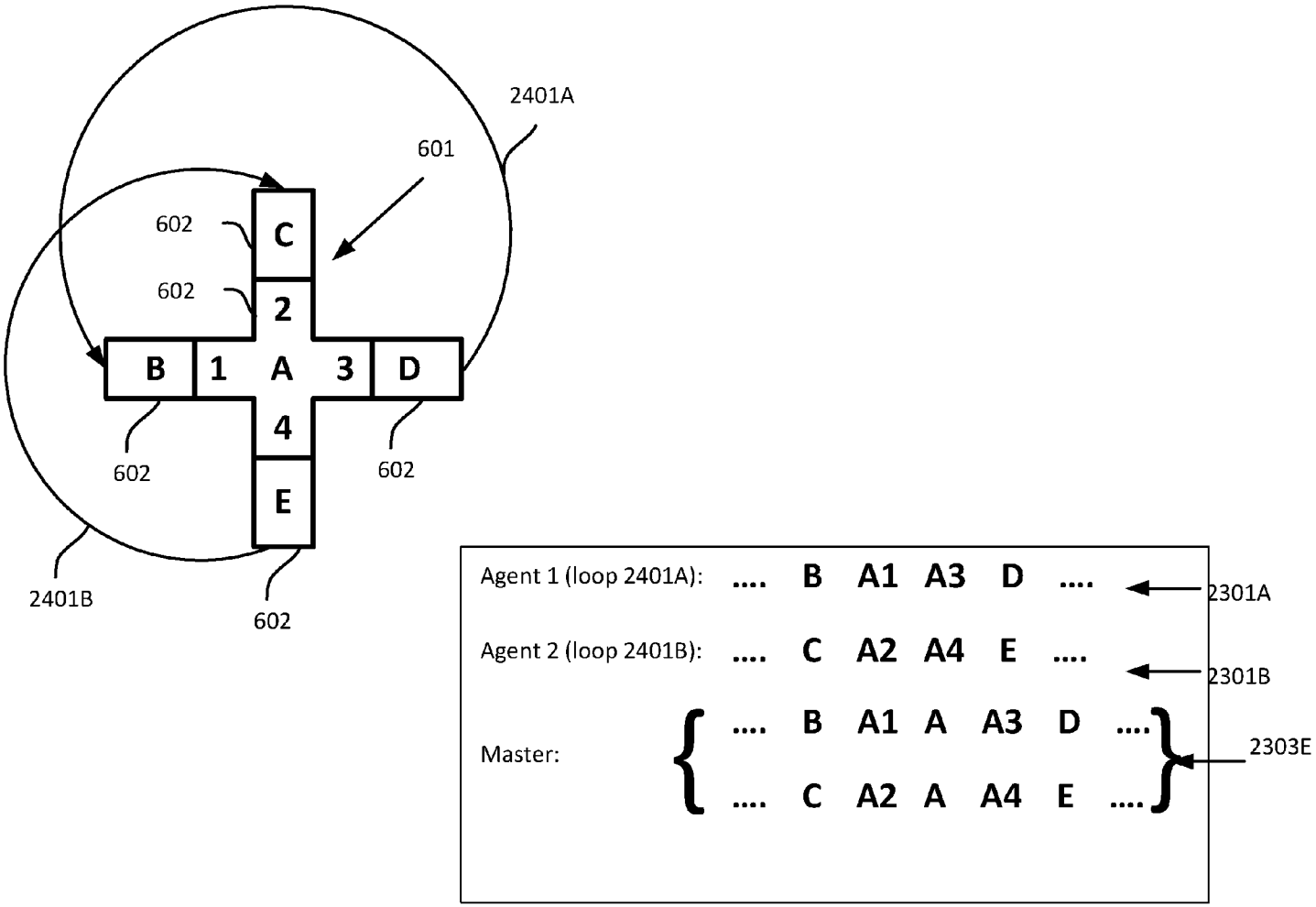
FIG. 24 depicts an example of a process for exploring multiple branches of a map representing a drivable surface, according to one embodiment.

Referring now to FIG. 24, there is shown an example of a process for exploring multiple branches of a map representing a drivable surface 601, according to one embodiment. One mobile agent 104 (Agent 1), explores loop 2401A, and generates the following CodeEntryList 2301A based on information collected from drivable surface segments 602 along loop 2401A:

B, A1, A3, D . . . .

The other mobile agent 104 (Agent 2), explores loop 2401B, and generates the following CodeEntryList 2301B based on information collected from drivable surface segments 602 along loop 2401B:

C, A2, A4, E . . . .

From this information, a set of AggregatedCodeEntryLists 2303E is generated, containing stitched information from the two CodeEntryLists 2301A, 2301B as shown.

In at least one embodiment, the system is able to begin operation, with mobile agents 104 traveling on drivable surface 601, even before the full map has been generated. For example, in some situations, the above-described method, including generating 1705 a coherent map, may result in a map that has missing information in one or more AggregatedCodeEntryLists 2303. A particular element of an AggregatedCodeEntryList 2303 might have no valid entries from any of the CodeEntryLists 2301, and may therefore be an unknown drivable surface segment 602.

In at least one embodiment, where appropriate, the system attempts to make intelligent guesses about such unknown elements of an AggregatedCodeEntryList 2303. For example, the system may try all possible shapes for the missing drivable surface segment 602 (such as left turn, right turn, straight, and/or the like) to see which one would best satisfy map requirements. If the number of unknown elements is below a defined threshold, and the system is sufficiently confident of the intelligent guesses, the map can be deemed complete, and main operation (gameplay) can begin. In at least one embodiment, the drivable surface segments 602 for which there is uncertainty can be marked as such; during main operation, additional information can be collected from mobile agents 104 to reinforce the guess or to make corrections when the guess is found to be inaccurate.

Figure 22:
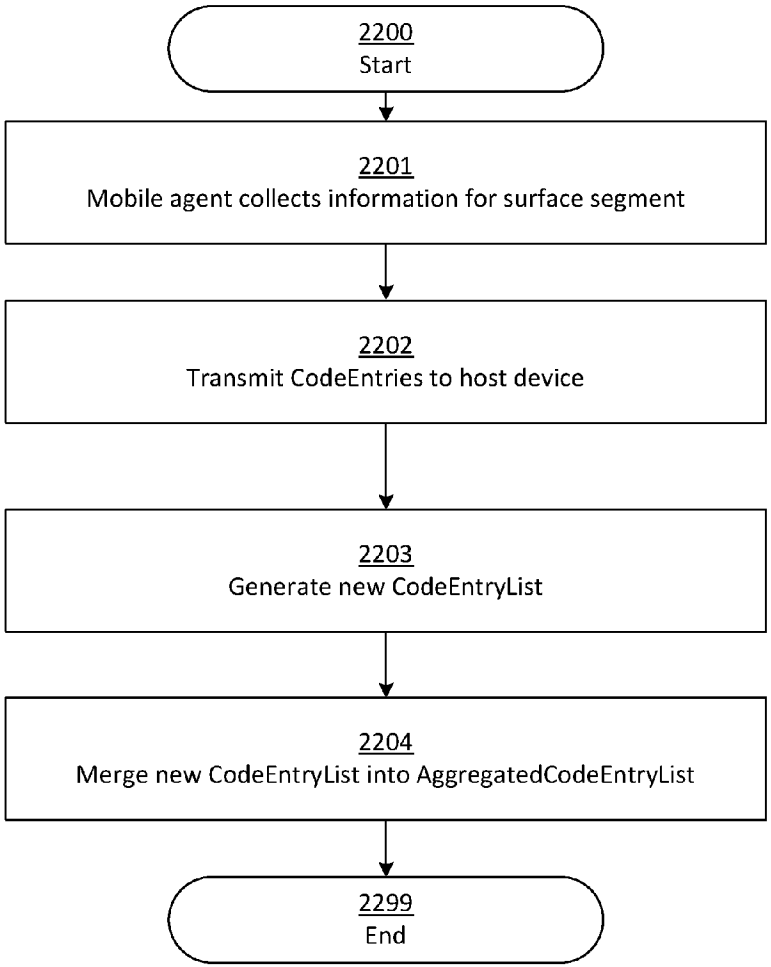
FIG. 22 is a flow diagram depicting a method of making corrections to a virtual representation of a drivable surface, according to one embodiment.

Referring now to FIG. 22, there is shown a flow diagram depicting a method of making corrections to a virtual representation of drivable surface 601, even after normal operation (gameplay) has begun, according to one embodiment. In this embodiment, even after operation has begun, the system continues to collect information from mobile agents 104, particularly as they traverse drivable surface segments 602 for which information is missing or ambiguous. Furthermore, such continued exploration during normal operation can help to detect and correct errors, and/or changes to configuration (for example, if the user picks up or moves segments 602 during gameplay).

In at least one embodiment, mobile agent(s) 104 continue to collect 2201 information about surface segments 602 after normal operation (gameplay) has begun; this information may take the form of new CodeEntries that describe configuration of one or more surface segments 602. Upon collecting 2201 such CodeEntries, mobile agent 104 transmits 2202 the CodeEntries to host device 108, which records them and generates 2203 a new CodeEntryList (or more than one new CodeEntryList) from the CodeEntries. The new CodeEntryList is then merged 2204 into the AggregatedCodeEntryList, so as to update the AggregatedCodeEntryList with the newest available information. In this manner, "holes" in the map can be filled, and updates can be made to ensure that the map properly reflects any changes made to the drivable surface 601.

In at least one embodiment, the validity and trustworthiness of previously generated CodeEntryLists are configured to diminish over time; in other words, newly generated CodeEntryLists are trusted more than older ones. As a result, if the user reconfigures drivable surface 601 on-the-fly (for example by moving, removing, or adding surface segments 602), so that the system starts to generate CodeEntryLists that drastically differ from previous ones, the newer CodeEntryLists will be trusted more than the previous ones. More particularly, any hypotheses corresponding to the old configuration will stop getting new observations, while the hypotheses corresponding to the new configuration will receive more new observations and will therefore be scored more highly. As a result, the maps will reliably transition to the newer configuration, as the old configuration's likelihood score continues to drop and the newer configuration's likelihood score increases. At a certain point, the new version of the map will have a higher likelihood score than the older version, and it will be considered to be correct.

In at least one embodiment, multiple mobile agents 104 can explore simultaneously. Using multiple mobile agents 104 allows for quicker identification of the configuration of drivable surface 601. In at least one embodiment, the system takes into account any uncertainty in the respective locations of agents 104, in order to prevent collisions. For example, two intersection segments 602 in the system may have the same type, so mobile agents 104 ensure that if there is uncertainty about which segment 602 they are on, they are performing actions that under any possible scenario will not cause them to collide during exploration.

The above description and referenced drawings set forth particular details with respect to possible embodiments. Those of skill in the art will appreciate that other embodiments are possible. First, the particular naming of the components, capitalization of terms, the attributes, data structures, or any other programming or structural aspect is not mandatory or significant, and the mechanisms described herein may have different names, formats, or protocols. Further, the system may be implemented via a combination of hardware and software, or entirely in hardware elements, or entirely in software elements. Also, the particular division of functionality between the various system components described herein is merely exemplary, and not mandatory; functions performed by a single system component may instead be performed by multiple components, and functions performed by multiple components may instead be performed by a single component.

Reference in the specification to "one embodiment" or to "an embodiment" means that a particular feature, structure, or characteristic described in connection with the embodiments is included in at least one embodiment. The appearances of the phrases "in one embodiment" or "in at least one embodiment" in various places in the specification are not necessarily all referring to the same embodiment.

Some embodiments may include a system or a method for performing the above-described techniques, either singly or in any combination. Other embodiments may include a computer program product comprising a non-transitory computer-readable storage medium and computer program code, encoded on the medium, for causing a processor in a computing device or other electronic device to perform the above-described techniques.

Some portions of the above are presented in terms of algorithms and symbolic representations of operations on data bits within a memory of a computing device. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic or optical signals capable of being stored, transferred, combined, compared and otherwise manipulated. It is convenient at times, principally for reasons of common usage, to refer to these signals as bits, values, elements, symbols, characters, terms, numbers, or the like. Furthermore, it is also convenient at times, to refer to certain arrangements of steps requiring physical manipulations of physical quantities as modules or code devices, without loss of generality.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "displaying" or "determining" or the like, refer to the action and processes of a computer system, or similar electronic computing module and/or device, that manipulates and transforms data represented as physical (electronic) quantities within the computer system memories or registers or other such information storage, transmission or display devices.

Certain aspects include process steps and instructions described herein in the form of an algorithm. It should be noted that the process steps and instructions can be embodied in software, firmware and/or hardware, and when embodied in software, can be downloaded to reside on and be operated from different platforms used by a variety of operating systems.

Some embodiments relate to an apparatus for performing the operations herein. This apparatus may be specially constructed for the required purposes, or it may comprise a general-purpose computing device selectively activated or reconfigured by a computer program stored in the computing device. Such a computer program may be stored in a computer readable storage medium, such as, but is not limited to, any type of disk including floppy disks, optical disks, CD-ROMs, DVD-ROMs, magnetic-optical disks, read-only memories (ROMs), random access memories (RAMs), EPROMs, EEPROMs, flash memory, solid state drives, magnetic or optical cards, application specific integrated circuits (ASICs), or any type of media suitable for storing electronic instructions, and each coupled to a computer system bus. Further, the computing devices referred to herein may include a single processor or may be architectures employing multiple processor designs for increased computing capability.

The algorithms and displays presented herein are not inherently related to any particular computing device, virtualized system, or other apparatus. Various general-purpose systems may also be used with programs in accordance with the teachings herein, or it may prove convenient to construct more specialized apparatus to perform the required method steps. The required structure for a variety of these systems will be apparent from the description provided herein. In addition, the system and method set forth herein are not described with reference to any particular programming language. It will be appreciated that a variety of programming languages may be used to implement the teachings described herein, and any references above to specific languages are provided for illustrative purposes only.

Accordingly, various embodiments may include software, hardware, and/or other elements for controlling a computer system, computing device, or other electronic device, or any combination or plurality thereof. Such an electronic device can include, for example, a processor, an input device (such as a keyboard, mouse, touchpad, track pad, joystick, trackball, microphone, and/or any combination thereof), an output device (such as a screen, speaker, and/or the like), memory, long-term storage (such as magnetic storage, optical storage, and/or the like), and/or network connectivity, according to techniques that are well known in the art. Such an electronic device may be portable or non-portable. Examples of electronic devices that may be used include: a mobile phone, personal digital assistant, smartphone, kiosk, server computer, enterprise computing device, desktop computer, laptop computer, tablet computer, consumer electronic device, or the like. An electronic device for implementing the system or method described herein may use any operating system such as, for example and without limitation: Linux; Microsoft Windows, available from Microsoft Corporation of Redmond, Wash.; Mac OS X, available from Apple Inc. of Cupertino, Calif.; iOS, available from Apple Inc. of Cupertino, Calif.; Android, available from Google, Inc. of Mountain View, Calif.; and/or any other operating system that is adapted for use on the device.

While a limited number of embodiments has been described herein, those skilled in the art, having benefit of the above description, will appreciate that other embodiments may be devised which do not depart from the scope of the claims. In addition, it should be noted that the language used in the specification has been principally selected for readability and instructional purposes, and may not have been selected to delineate or circumscribe the inventive subject matter. Accordingly, this disclosure is intended to be illustrative, but not limiting.

What is claimed is:

1. A system comprising:

a surface having a layout, and comprising a plurality of machine-readable codes, each machine-readable code identifying at least one characteristic of a portion of the surface;

a plurality of mobile agents configured to explore the surface contemporaneously with one another, each mobile agent comprising:

a propulsion mechanism, configured to impart motive force to cause the mobile agent to travel along the surface;

a sensor, configured to detect the machine-readable codes as the mobile agent travels along the surface;

a mobile wireless transceiver, configured to transmit at least one signal representing the detected machine-readable codes; and a microcontroller, operatively coupled to control the operation of the propulsion mechanism, the sensor, and the mobile wireless transceiver; and a host device, comprising:

a wireless transceiver, configured to receive signals representing detected machine-readable codes from the mobile agents;

a processor, operatively coupled to the wireless transceiver, configured to determine the layout of the surface by merging information from the signals received from at least two of the mobile agents; and a storage device, operatively coupled to the wireless transceiver, configured to store a virtual representation of the surface based on the determined layout;

wherein the host device is configured to implement an entertainment activity for the plurality of mobile agents based on the virtual representation.

2. The system of claim 1, wherein the layout comprises a loop, and wherein the mobile agents are configured to explore the surface by traversing the loop.

3. The system of claim 2, wherein at least one portion of the surface comprises a branching path having at least two branches, each branch leading to a different loop, and wherein at least one of the mobile agents is configured to explore the surface by traversing the different loops.

4. The system of claim 1, wherein the wireless transceiver of the host device is further configured to transmit a signal to cause the mobile agents to explore the surface.

5. The system of claim 1, wherein:

at least one of the mobile agents is configured to further explore the surface;

the sensor of the at least one mobile agent is configured to detect additional machine-readable codes as the mobile agent travels along the surface;

the mobile wireless transceiver of the at least one mobile agent is configured to transmit at least one additional signal representing the additional detected machine-readable codes;

the wireless transceiver of the host device is configured to receive the at least one additional signal representing the additional detected machine-readable codes from the at least one mobile agent;

the processor is configured to update the determined layout of the surface based on the received at least one at least one additional signal; and the storage device is configured to update the stored virtual representation of the surface based on the updated layout.

6. The system of claim 5, wherein the layout is changeable, and wherein the detected additional machine-readable codes indicate a change to the layout of the surface.

7. The system of claim 6, wherein at least one portion of the surface comprises a branching path having at least two branches, each branch leading to a different loop, and wherein:

at least one of the mobile agents is configured to explore at least one of the loops; and at least one other of the mobile agents is configured to explore at least one other of the loops.

8. The system of claim 1, wherein:

at least a subset of the received signals provide conflicting information about the layout of the surface; and the processor is configured to determine the layout of the surface by reconciling the conflicting information.

9. The system of claim 8, wherein the processor is configured to reconcile the conflicting information by:

determining a plurality of hypotheses representing alternative possible layouts;

generating a relative confidence metric for each hypothesis; and selecting the hypothesis having the highest confidence metric.

10. The system of claim 1, wherein the processor is configured to determine the layout of the surface by:

determining a plurality of code entries from the received signals, each code entry representing an identified portion of the surface at an identified topological location;

aggregating the determined code entries; and generating a coherent map from the aggregation of code entries.

11. The system of claim 1, further comprising at least one controller controlled by at least one human user, wherein each controller is configured to control at least one mobile agent.

12. The system of claim 11, wherein each controller comprises at least one selected from the group consisting of:

a mobile computing device;

a smartphone;

a tablet computer;

a desktop computer;

a laptop computer;

a video game console; and a kiosk;

and wherein the host device comprises at least one selected from the group consisting of:

a mobile computing device;

a smartphone;

a tablet computer;

a desktop computer;

a laptop computer;

a video game console; and a kiosk.

13. The system of claim 1, further comprising:

an automated computing system, configured to control at least one of the mobile agents in an automated manner.

14. The system of claim 1, wherein the surface comprises a plurality of segments.

15. The system of claim 14, wherein the at least one characteristic of a portion of the surface comprises an identifier for one of the segments.

16. The system of claim 1, wherein each mobile agent comprises a toy vehicle.

17. A method for determining a layout of a surface comprising a plurality of machine-readable codes, each machine-readable code identifying at least one characteristic of a portion of the surface, the method comprising:

detecting, via sensors of a plurality of mobile agents configured to explore the surface contemporaneously with one another, machine readable codes as the mobile agents travel along the surface, each machine-readable code identifying at least one characteristic of a portion of the surface;

at a wireless transceiver of a host device, receiving signals representing detected machine-readable codes from the mobile agents;

at a processor of the host device, determining the layout of the surface by merging information from the signals received from at least two of the mobile agents;

at a storage device, storing a virtual representation of the surface based on the determined layout; and at the processor of the host device implementing an entertainment activity for the plurality of mobile agents based on the virtual representation.

18. The method of claim 17, wherein the layout comprises a loop, and wherein exploring the surface comprises traversing the loop.

19. The method of claim 18, wherein at least one portion of the surface comprises a branching path having at least two branches, each branch leading to a different loop, and wherein exploring the surface comprises traversing the different loops.

20. The method of claim 17, further comprising transmitting a signal from the wireless transceiver of the host device, to cause the mobile agents to explore the surface.

21. The method of claim 17, further comprising:

causing at least one of the mobile agents to further explore the surface;

detecting, via at least one sensor of at least one mobile agent, additional machine-readable codes as the mobile agent travels along the surface;

at the wireless transceiver of the host device, receiving at least one additional signal from the at least one mobile agent, each received additional signal representing additional detected machine-readable codes;

at the processor of the host device, updating the determined layout of the surface based on the received at least one at least one additional signal; and at the storage device, updating the stored virtual representation of the surface based on the updated layout.

22. The method of claim 21, wherein the layout is changeable, and wherein the detected additional machine-readable codes indicate a change to the layout of the surface.

23. The method of claim 22, wherein at least one portion of the surface comprises a branching path having at least two branches, each branch leading to a different loop, the method further comprising:

causing at least one of the mobile agents to explore at least one of the loops; and causing at least one other of the mobile agents to explore at least one other of the loops.

24. The method of claim 17, wherein:

at least a subset of the received signals provide conflicting information about the layout of the surface; and determining the layout of the surface comprises reconciling the conflicting information.

25. The method of claim 24, wherein reconciling the conflicting information comprises:

determining a plurality of hypotheses representing alternative possible layouts;

generating a relative confidence metric for each hypothesis; and selecting the hypothesis having the highest confidence metric.

26. The method of claim 17, wherein determining the layout of the surface comprises:

determining a plurality of code entries from the received signals, each code entry representing an identified portion of the surface at an identified topological location;

aggregating the determined code entries; and generating a coherent map from the aggregation of code entries.

27. The method of claim 17, wherein at least one of the mobile agents is controlled by a controller, the method comprising:

receiving, at the controller, user input from at least one human user; and transmitting, from the controller to the at least one mobile agent, a signal directing movement of the at least one mobile agent.

28. The method of claim 27, wherein each controller comprises at least one selected from the group consisting of:

a mobile computing device;

a smartphone;

a tablet computer;

a desktop computer;

a laptop computer;

a video game console; and a kiosk;

and wherein the host device comprises at least one selected from the group consisting of:

a mobile computing device;

a smartphone;

a tablet computer;

a desktop computer;

a laptop computer;

a video game console; and a kiosk.

29. The method of claim 17, wherein at least one of the mobile agents is controlled by an automated computing system, the method comprising:

transmitting, from the automated computing system to the at least one mobile agent, a signal directing movement of the at least one mobile agent.

30. The method of claim 17, wherein the surface comprises a plurality of segments.

31. The method of claim 30, wherein the at least one characteristic of a portion of the surface comprises an identifier for one of the segments.

32. The method of claim 17, wherein each mobile agent comprises a toy vehicle.

33. A non-transitory computer program product for determining a layout of a surface comprising a plurality of machine-readable codes, each machine-readable code identifying at least one characteristic of a portion of the surface, the non-transitory computer program product comprising instructions stored thereon, that when executed on a processor of a host device, perform the steps of:

receiving signals from a plurality of mobile agents configured to explore the surface contemporaneously with one another and to detect, via at least one sensor, machine readable codes as the mobile agents travel along the surface, each machine-readable code identifying at least one characteristic of a portion of the surface, each received signal representing at least one detected machine-readable code;

determining the layout of the surface by merging information from the signals received from at least two of the mobile agents;

causing a storage device to store a virtual representation of the surface based on the determined layout; and implementing an entertainment activity for the plurality of mobile agents based on the virtual representation.

34. The non-transitory computer program product of claim 33, wherein the layout comprises a loop, and wherein the mobile agents are configured to explore the surface by traversing the loop.

35. The non-transitory computer program product of claim 34, wherein at least one portion of the surface comprises a branching path having at least two branches, each branch leading to a different loop, and wherein at least one of the mobile agents is configured to explore the surface by traversing the different loops.

36. The non-transitory computer program product of claim 33, wherein the non-transitory computer-readable medium further comprises instructions stored thereon, that when executed on a processor, perform the step of transmitting a signal from the wireless transceiver of the host device, to cause the mobile agents to explore the surface.

37. The non-transitory computer program product of claim 33, wherein the non-transitory computer-readable medium further comprises instructions stored thereon, that when executed on a processor, perform the steps of:

causing at least one of the mobile agents to further explore the surface;

receiving at least one additional signal from the at least one mobile agent, each received additional signal representing additional detected machine-readable codes;

updating the determined layout of the plurality of segments based on the received at least one at least one additional signal; and causing the storage device to update the stored virtual representation of the surface based on the updated layout.

38. The non-transitory computer program product of claim 37, wherein the layout is changeable, and wherein the detected additional machine-readable codes indicate a change to the layout of the surface.

39. The non-transitory computer program product of claim 38, wherein at least one portion of the surface comprises a branching path having at least two branches, each branch leading to a different loop, and wherein the non-transitory computer-readable medium further comprises instructions stored thereon, that when executed on a processor, perform the steps of:

causing at least one of the mobile agents to explore at least one of the loops; and causing at least one other of the mobile agents to explore at least one other of the loops.

40. The non-transitory computer program product of claim 33, wherein:

at least a subset of the received signals provide conflicting information about the layout of the surface; and determining the layout of the surface comprises reconciling the conflicting information.

41. The non-transitory computer program product of claim 40, wherein reconciling the conflicting information comprises:

determining a plurality of hypotheses representing alternative possible layouts;

generating a relative confidence metric for each hypothesis; and selecting the hypothesis having the highest confidence metric.

42. The non-transitory computer program product of claim 33, wherein determining the layout of the surface comprises:

determining a plurality of code entries from the received signals, each code entry representing an identified portion of the surface at an identified topological location;

aggregating the determined code entries; and generating a coherent map from the aggregation of code entries.

43. The non-transitory computer program product of claim 33, wherein the surface comprises a plurality of segments.

44. The non-transitory computer program product of claim 43, wherein the at least one characteristic of a portion of the surface comprises an identifier for one of the segments.

45. The non-transitory computer program product of claim 33, wherein each mobile agent comprises a toy vehicle.

* * * * *